US009316963B2

(12) United States Patent
Masuda et al.

(10) Patent No.: US 9,316,963 B2
(45) Date of Patent: Apr. 19, 2016

(54) IMAGE FORMING APPARATUS

(71) Applicants: Koji Masuda, Kanagawa (JP); Susumu Momma, Kanagawa (JP); Hidemasa Suzuki, Kanagawa (JP)

(72) Inventors: Koji Masuda, Kanagawa (JP); Susumu Momma, Kanagawa (JP); Hidemasa Suzuki, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/473,385

(22) Filed: Aug. 29, 2014

(65) Prior Publication Data

US 2015/0063844 A1 Mar. 5, 2015

(30) Foreign Application Priority Data

Sep. 5, 2013 (JP) ..... 2013-183642

(51) Int. Cl.
*G03G 15/00* (2006.01)
*G03G 15/20* (2006.01)

(52) U.S. Cl.
CPC .... *G03G 15/2017* (2013.01); *G03G 2215/2032* (2013.01)

(58) Field of Classification Search
CPC ..... G03G 15/2017; G03G 15/205; G03G 15/2053
USPC ..... 399/33, 69
See application file for complete search history.

(56) References Cited

U.S. PATENT DOCUMENTS

| | | | | |
|---|---|---|---|---|
| 6,122,042 | A * | 9/2000 | Wunderman et al. | 356/73 |
| 2006/0165449 | A1* | 7/2006 | Ito et al. | 399/329 |
| 2008/0240748 | A1* | 10/2008 | Kinouchi et al. | 399/33 |
| 2009/0238590 | A1 | 9/2009 | Masuda | |
| 2010/0008686 | A1 | 1/2010 | Masuda et al. | |
| 2010/0266302 | A1 | 10/2010 | Suzuki et al. | |
| 2010/0310284 | A1 | 12/2010 | Funato et al. | |
| 2011/0043810 | A1 | 2/2011 | Suzuki et al. | |
| 2011/0044713 | A1 | 2/2011 | Masuda et al. | |

(Continued)

FOREIGN PATENT DOCUMENTS

| | | |
|---|---|---|
| JP | 05-013739 | 1/1993 |
| JP | 05-113739 | 5/1993 |

(Continued)

OTHER PUBLICATIONS

U.S. Appl. No. 14/208,621, filed Mar. 13, 2014.

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

An image forming apparatus includes a fixing member, at least one reflective optical sensor, a heat shielding member, and a processor. The fixing member fixes an image on a recording medium moving in a first axis direction. At least one reflective optical sensor emits light toward the fixing member and receives light reflected by the fixing member. The heat shielding member is arranged between the fixing member and the at least one reflective optical sensor, has a light passing part through which light directed to the fixing member from the at least one reflective optical sensor and light reflected by the fixing member and directed to the at least one reflective optical sensor passes, and prevents heat transfer from the fixing member to the at least one reflective optical sensor. The processor is configured to obtain a surface state of the fixing member on the basis of an output signal from the at least one reflective optical sensor.

8 Claims, 28 Drawing Sheets

(56) References Cited

U.S. PATENT DOCUMENTS

| | | | | |
|---|---|---|---|---|
| 2011/0222933 | A1* | 9/2011 | Maruyama et al. | 399/329 |
| 2012/0207495 | A1* | 8/2012 | Sakuraba et al. | 399/44 |
| 2012/0268750 | A1 | 10/2012 | Masuda | |
| 2013/0216267 | A1 | 8/2013 | Masuda et al. | |
| 2013/0243446 | A1 | 9/2013 | Masuda | |
| 2013/0243458 | A1 | 9/2013 | Suzuki et al. | |
| 2013/0251389 | A1 | 9/2013 | Suzuki et al. | |
| 2013/0308966 | A1 | 11/2013 | Masuda et al. | |
| 2014/0023391 | A1 | 1/2014 | Masuda | |
| 2014/0044460 | A1 | 2/2014 | Kudo et al. | |
| 2014/0071443 | A1 | 3/2014 | Suzuki et al. | |
| 2014/0219670 | A1 | 8/2014 | Masuda et al. | |

FOREIGN PATENT DOCUMENTS

| | | |
|---|---|---|
| JP | 2007-034068 | 2/2007 |
| JP | 2010-262023 | 11/2010 |
| JP | 4632820 | 11/2010 |

* cited by examiner

IMAGE FORMING APPARATUS

CROSS-REFERENCE TO RELATED APPLICATIONS

The present application claims priority to and incorporates by reference the entire contents of Japanese Patent Application No. 2013-183642 filed in Japan on Sep. 5, 2013. The present application further incorporates by reference the entire contents of Japanese Patent Application No. 2012-199030 filed in Japan on Sep. 11, 2012.

BACKGROUND OF THE INVENTION

1. Field of the Invention

The present invention relates to an image forming apparatus, and more particularly, to an image forming apparatus that forms images by using toner.

2. Description of the Related Art

An image forming apparatus typically includes a photosensitive drum, and a charging device, an exposure device, a developing device, and the like that are arranged around the photosensitive drum. The surface of the photosensitive drum is uniformly charged by the charging device, and the charged part is exposed to layer light emitted by the exposure device. As a result, an electrostatic latent image is formed on the photosensitive drum, and the electrostatic latent image is developed by the developing device into a toner image.

The toner image on the photosensitive drum is transferred onto a sheet conveyed by a conveyance belt. The sheet onto which the toner image is transferred is separated from the conveyance belt and conveyed to a fixing device, where the toner is fixed and the sheet is discharged.

The fixing device includes a fixing belt for heating and applying pressure to the sheet.

For example, if fixing onto an A4 size sheet fed in the portrait direction is repeated in an image forming apparatus capable of using A4 size sheets and A3 size sheets, a vertical crack may be caused at a position where ends of the A4 size sheets in the sheet width direction on the surface of the fixing belt. This is because the surface of the fixing belt is roughened by paper powder from the sheet ends.

In this case, when an A4 sheet is fed in the landscape direction or an A3 sheet is fed in the portrait direction, what is called a glossy stripe is caused on the surface of the image corresponding to the vertical crack, which degrades image quality.

Image forming apparatuses considering roughening of the surface of a fixing belt have therefore been devised (for example, refer to JP 5-113739 A, JP 4632820 B1, JP 2007-34068 A, and JP 2010-262023 A).

The demands for higher image quality of image forming apparatuses are increasing every year. With the image forming apparatuses disclosed in JP 5-113739 A, JP 4632820 B1, JP 2007-34068 A, and JP 2010-262023 A, however, it is difficult to achieve the required level of image quality.

SUMMARY OF THE INVENTION

It is an object of the present invention to at least partially solve the problems in the conventional technology.

According to an embodiment, an image forming apparatus includes a fixing member, at least one reflective optical sensor, a heat shielding member, and a processor. The fixing member fixes an image on a recording medium moving in a first axis direction. At least one reflective optical sensor emits light toward the fixing member and receives light reflected by the fixing member. The heat shielding member is arranged between the fixing member and the at least one reflective optical sensor, has a light passing part through which light directed to the fixing member from the at least one reflective optical sensor and light reflected by the fixing member and directed to the at least one reflective optical sensor passes, and prevents heat transfer from the fixing member to the at least one reflective optical sensor. The processor is configured to obtain a surface state of the fixing member on the basis of an output signal from the at least one reflective optical sensor.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
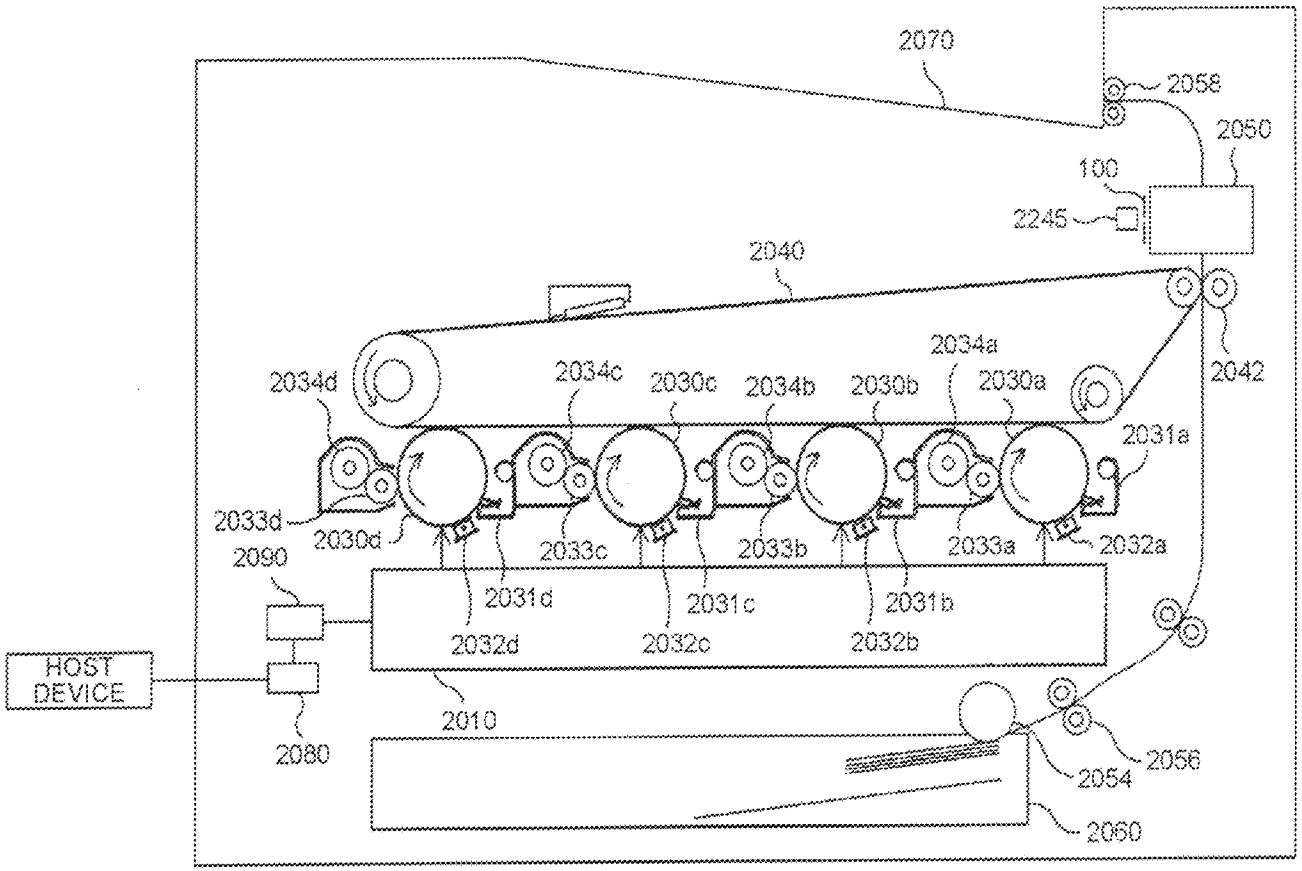
FIG. 1 is a diagram for explaining a schematic configuration of a color printer according to an embodiment of the present invention.

An embodiment of the present invention will be described below with reference to FIGS. 1 to 21. FIG. 1 illustrates a schematic configuration of a color printer 2000 according to an embodiment.

The color printer 2000 is a tandem multicolor printer configured to form full-color images by combining four colors (black, cyan, magenta, and yellow), and includes an optical scanning device 2010, four photosensitive drums (2030*a*, 2030*b*, 2030*c*, 2030*d*), four cleaning units (2031*a*, 2031*b*, 2031*c*, 2031*d*), four charging devices (2032*a*, 2032*b*, 2032*c*, 2032*d*), four developing rollers (2033*a*, 2033*b*, 2033*c*, 2033*d*), an intermediate transfer belt. 2040, a secondary transfer roller 2042, a fixing device 2050, a sheet feeding roller 2054, a sheet discharge roller 2058, a sheet feeding tray 2060, a sheet discharge tray 2070, a communication controller 2080, a reflective optical sensor 2245, a heat shielding member 100, a control panel (not illustrated), a printer controller 2090 configured to generally control the respective components, and the like.

The communication controller 2080 controls bidirectional communication with a host device (such as a personal computer) via a network or the like.

The printer controller 2090 includes a CPU, a ROM storing programs written in codes that can be decoded by the CPU and various data used for executing the programs, a RAM that is a working memory, an amplifier circuit, an A/D converter circuit, and the like. The printer controller 2090 informs the optical scanning device 2010 of multicolor image information (black image information, cyan image information, magenta image information, yellow image information) from the host device received via the communication controller 2080.

The control panel includes multiple keys for performing various settings by the operator, and a display for displaying various information data.

The photosensitive drum 2030*a*, the charging device 2032*a*, the developing roller 2033*a*, and the cleaning unit. 2031*a* are used as a set and constitute an image forming station (hereinafter also referred to as a "K station" for convenience sake) for forming a black image.

The photosensitive drum 2030*b*, the charging device 2032*b*, the developing roller 2033*b*, and the cleaning unit 2031*b* are used as a set and constitute an image forming station (hereinafter also referred to as a "C station" for convenience sake) for forming a cyan image.

The photosensitive drum 2030*c*, the charging device 2032*c*, the developing roller 2033*c*, and the cleaning unit 2031*c* are used as a set and constitute an image forming station (hereinafter also referred to as an "M station" for convenience sake) for forming a magenta image.

The photosensitive drum 2030*d*, the charging device 2032*d*, the developing roller 2033*d*, and the cleaning unit 2031*d* are used as a set and constitute an image forming station (hereinafter also referred to as a "Y station" for convenience sake) for forming an yellow image.

Each of the photosensitive drums has a photosensitive layer formed on the surface. Herein, the surface of each photosensitive drum is a surface subjected to scanning. The respective photosensitive drums rotate in the direction of arrows in a plane in FIG. 1 by rotating mechanisms that are not illustrated.

Each of the charging devices uniformly charges the surface of the associated photosensitive drum.

The optical scanning device 2010 scans an associated charged photosensitive drum with light demodulated for each color on the basis of the multicolor image information from the printer controller 2090. As a result, a latent image corresponding to the image information is formed on the surface of each photosensitive drum. The latent image formed here moves in the direction toward the associated developing device with the rotation of the photosensitive drum.

The surface of each developing roller is uniformly coated with toner in a thin layer from an associated toner cartridge (not illustrated) with the rotation. When the toner on the surface of each developing roller is brought into contact with the surface of the associated photosensitive drum, the toner is transferred onto only part of the surface irradiated with light and adheres thereto. In other words, each developing roller makes the toner adhere to the latent image formed on the surface of the associated photosensitive drum to make the latent image visible. The image (toner image) to which toner is adhered then moves in the direction of the intermediate transfer belt 2040 with the rotation of the photosensitive drum.

The respective toner images of yellow, magenta, cyan, and black are sequentially transferred onto the intermediate transfer belt at predetermined timings, overlaid on one another to form a color image.

The sheet feeding tray 2060 stores recording paper. The sheet feeding roller 2054 is arranged near the sheet feeding tray 2060, and takes out the recording paper one sheet by one sheet from the sheet feeding tray 2060. The recording paper is fed toward a gap between the intermediate transfer belt 2040 and the secondary transfer roller 2042 at a predetermined timing. As a result, the toner image on the intermediate transfer belt 2040 is transferred onto the recording paper. The recording paper onto which the toner image is transferred is delivered to the fixing device 2050.

In the fixing device 2050, heat and pressure are applied to the recording paper, which fixes the toner onto the recording paper. The recording paper onto which the toner is fixed is delivered to the sheet discharge tray 2070 via the sheet discharge roller 2058, and sequentially stacked on the sheet discharge tray 2070.

Each of the cleaning units removes toner (residual toner) remaining on the surface of the associated photosensitive drum. The surface of the photosensitive drum from which the residual toner is removed returns to the position opposed to the associated charging device.

The reflective optical sensor 2245 is arranged near the fixing device 2050. Details of the reflective optical sensor 2245 will be described later.

Figure 2:
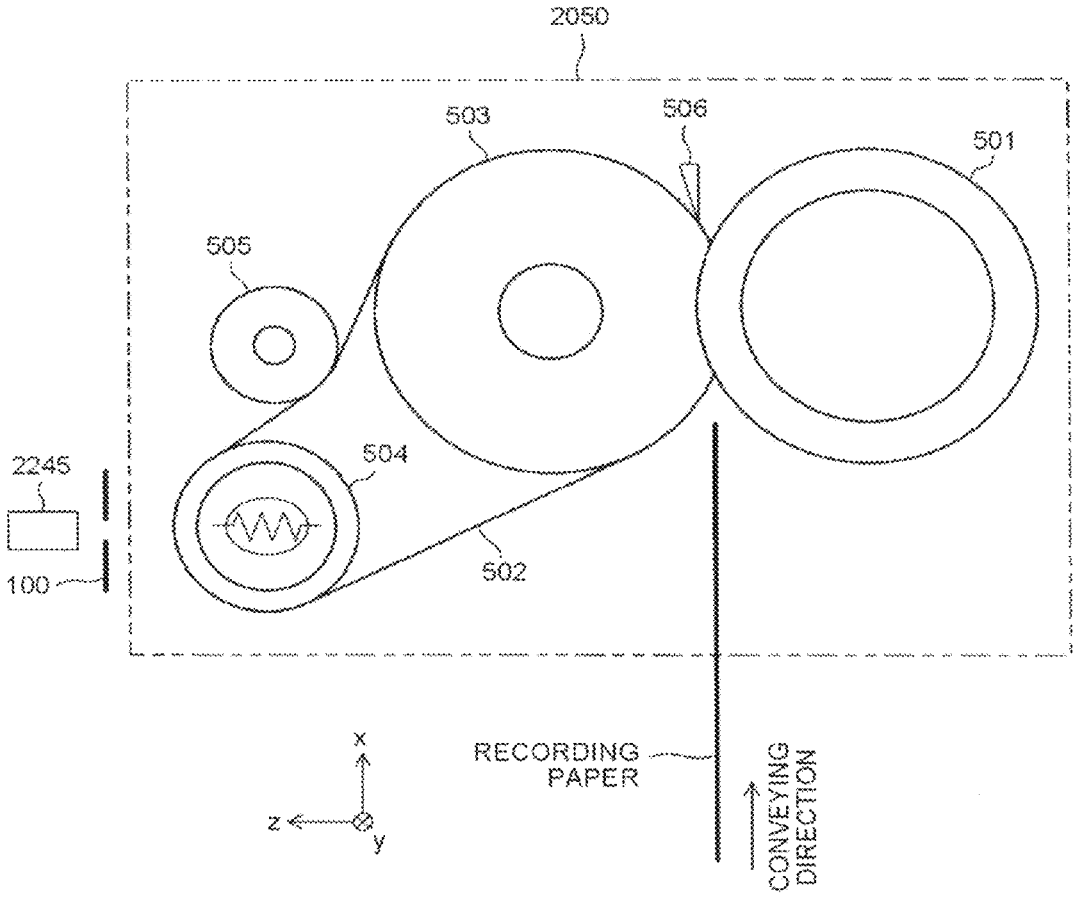
FIG. 2 is a diagram for explaining a fixing device.

The fixing device 2050 includes, as illustrated as an example in FIG. 2, a pressure roller 501, a fixing belt 502, a fixing roller 503, a heating roller 504, a tension roller 505, a separation claw 506, a temperature sensor (not illustrated), and the like.

Herein, the direction perpendicular to the surface of the recording paper conveyed to the fixing device 2050 is referred to a z-axis direction in an xyz three-dimensional coordinate system. Furthermore, the conveying direction of the recording paper is referred to as a +x direction.

The pressure roller 501 is made by covering a metal core made of aluminum, steel or the like with an elastic member made of silicone rubber or the like and coating the surface thereof with a fluorocarbon polymer.

The fixing belt 502 is made by coating the surface of a base material made of nickel, polyimide or the like with a fluorocarbon polymer. Alternatively, an elastic member made of silicone rubber or the like may be additionally provided between the base material and the fluorocarbon polymer.

The fixing belt 502 is looped around the fixing roller 503 and the heating roller 504, and kept at a proper tension by the tension roller 505.

The fixing roller 503 is made by covering a metal core made of aluminum, steel or the like with silicone rubber.

The heating roller 504 includes a hollow roller made of aluminum or steel and a heat source such as a halogen heater provided inside of the hollow roller.

The tension roller 505 is made by covering a metal core made of aluminum, steel or the like with silicone rubber.

Multiple separation claws 506 are provided along the direction parallel to the rotary shaft of the fixing roller 503 (herein, the v-axis direction). The end of each separation claw 506 is in contact with the surface of the fixing roller 503.

The temperature sensor detects the temperature of the fixing belt 502 on the heating roller 504 in a contactless manner. Alternatively, a contact-type temperature sensor may be used as the temperature sensor.

In the fixing device 2050, when the recording paper enters a nip portion formed by the fixing roller 503 and the pressure roller 501, a predetermined pressure and heat are applied to the recording paper and the toner image on the recording paper is fixed at the nip portion.

Figure 3:
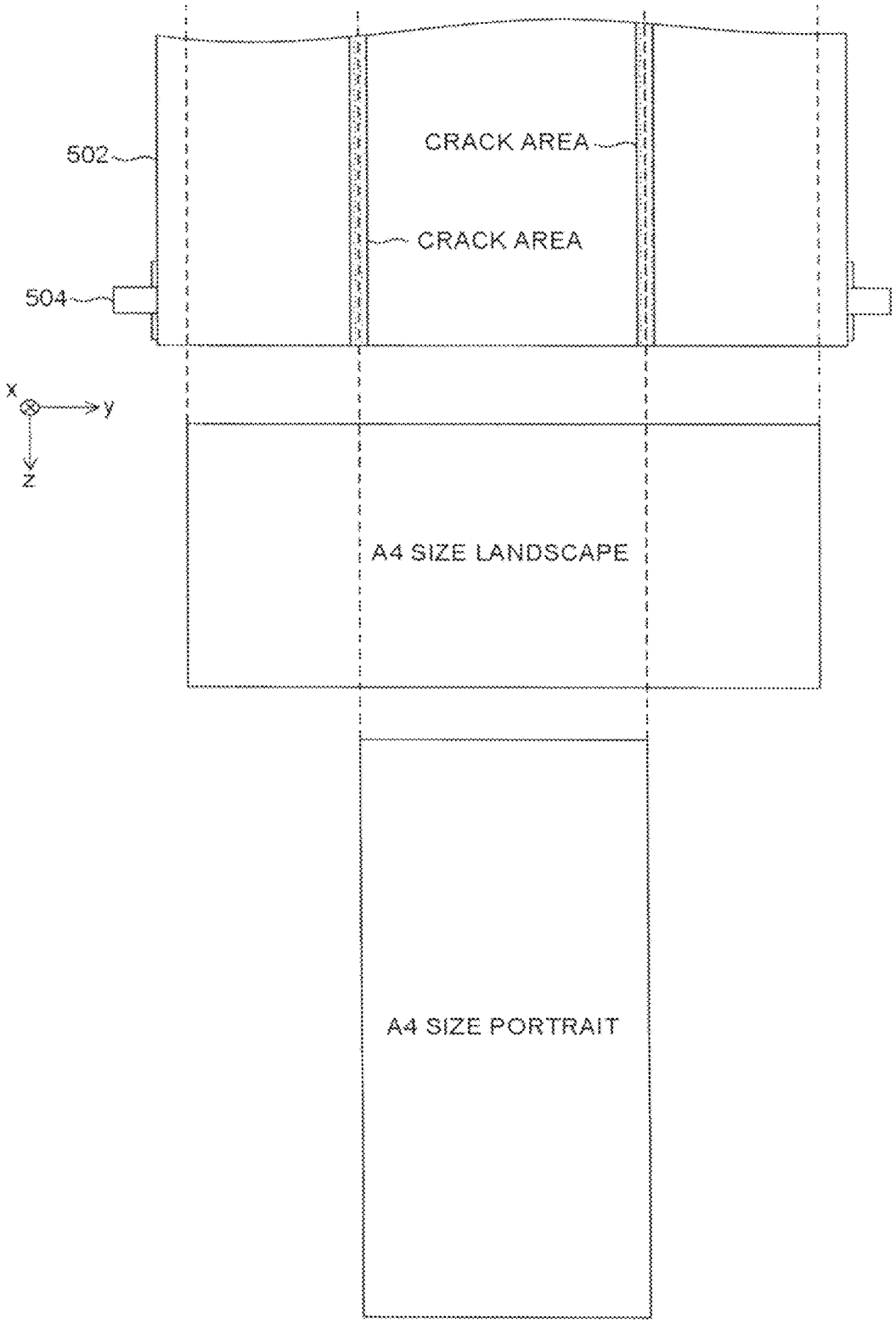
FIG. 3 is a diagram for explaining an area where a crack has occurred.
Figure 4:
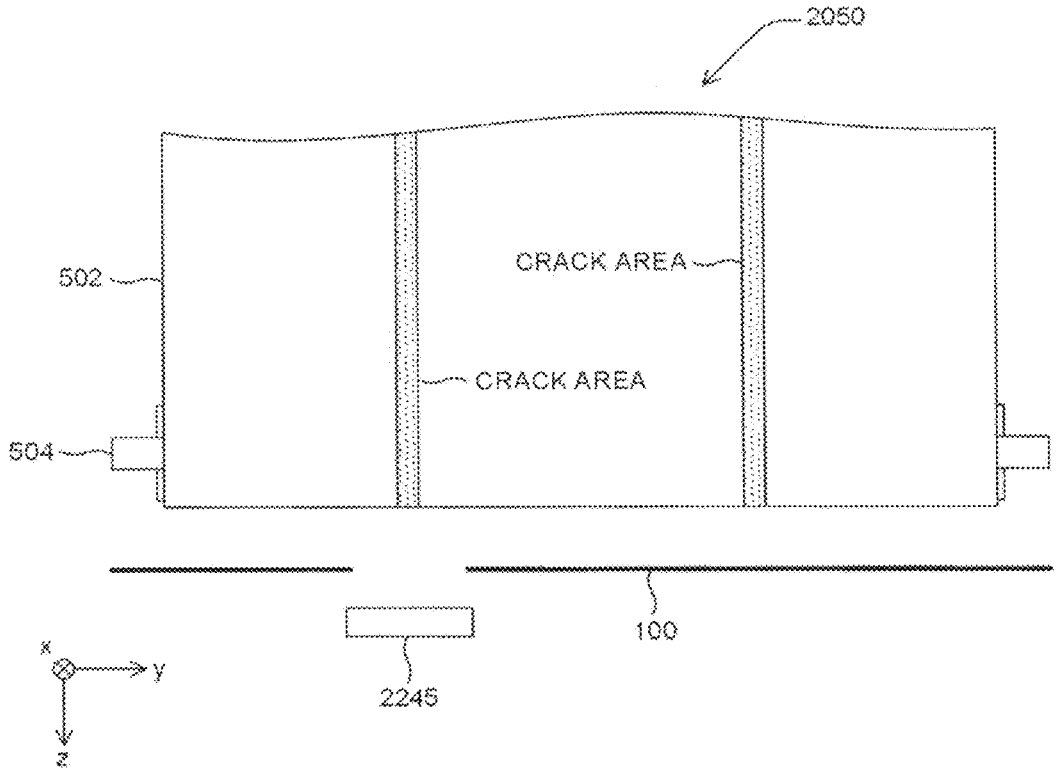
FIG. 4 is a diagram for explaining a position where a reflective optical sensor is arranged.
Figure 5:
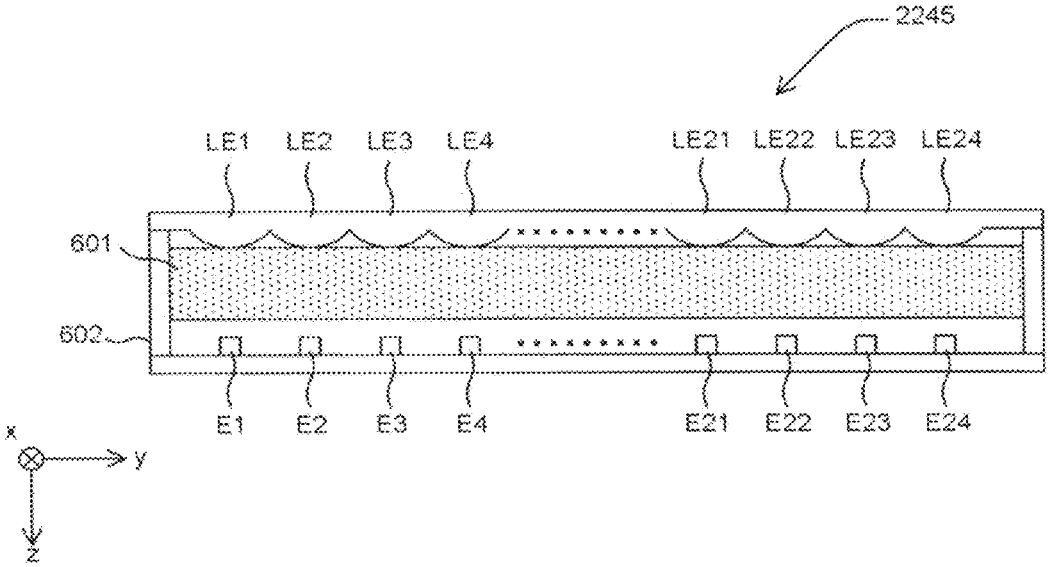
FIG. 5 is a first diagram for explaining the reflective optical sensor.
Figure 6:
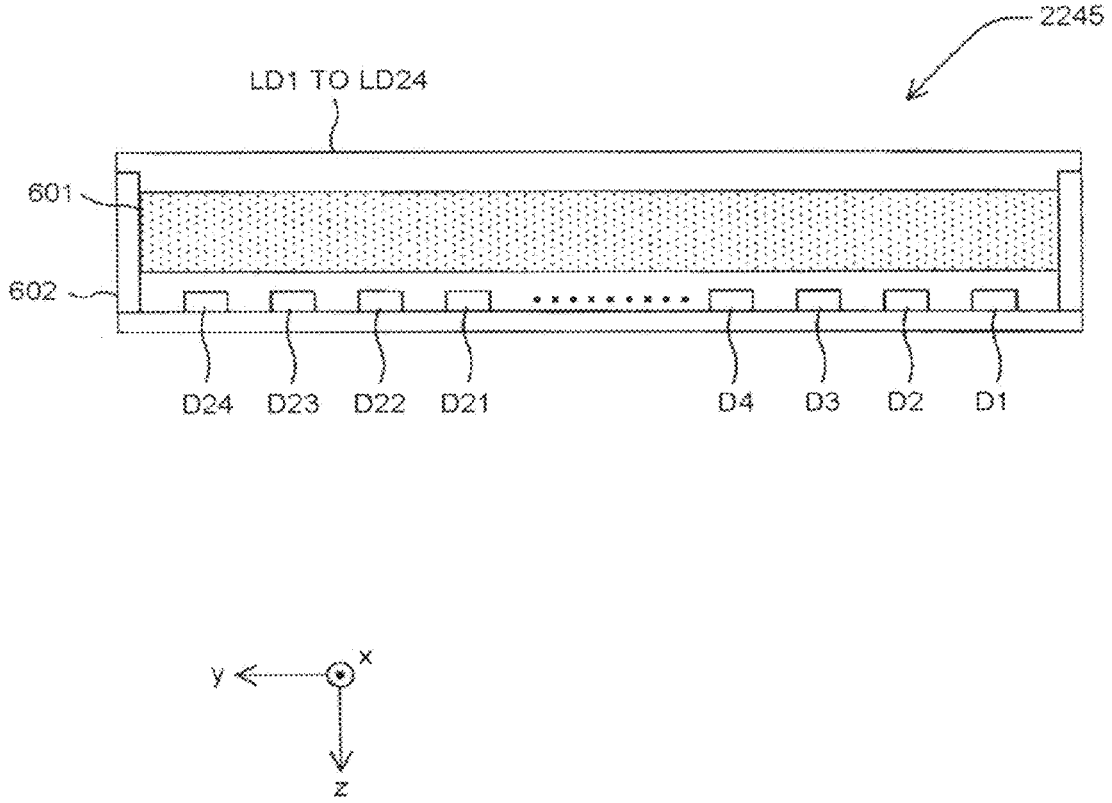
FIG. 6 is a second diagram for explaining the reflective optical sensor.

If fixing onto an A4 size sheet fed in the portrait direction is repeated in the fixing device 2050, a vertical crack, may be caused at a position where the ends of the A4 sheets in the sheet width direction on the surface of the fixing belt 502 (see FIG. 3). This is because the surface of the fixing belt 502 is roughened by paper powder from the end of the recording paper.

In this case, when the recording paper of an A4 size is fed in the landscape direction or of an A3 size is fed in the portrait direction, what is called a glossy stripe is caused on the surface of the image corresponding to the vertical crack, which degrades image quality.

Thus, to know the position of the crack and the state of the crack (the depth and the width of the crack) of the fixing belt 502, the reflective optical sensor 2245 is arranged near the fixing device 2050.

Next, the reflective optical sensor 2245 will be described.

The reflective optical sensor 2245 is arranged on the +z side of the fixing device 2050. In the y-axis direction, the reflective optical sensor 2245 is arranged at a position opposed to one of areas where the crack is caused (hereinafter simply referred to as "crack areas") of the fixing belt 502 (see FIG. 4). Although the reflective optical sensor 2245 is arranged at a position opposed to a crack area on the −y side of two crack areas in FIG. 4, the reflective optical sensor 2245 may be arranged at a position opposed to the crack area on the +y side.

Figure 7:
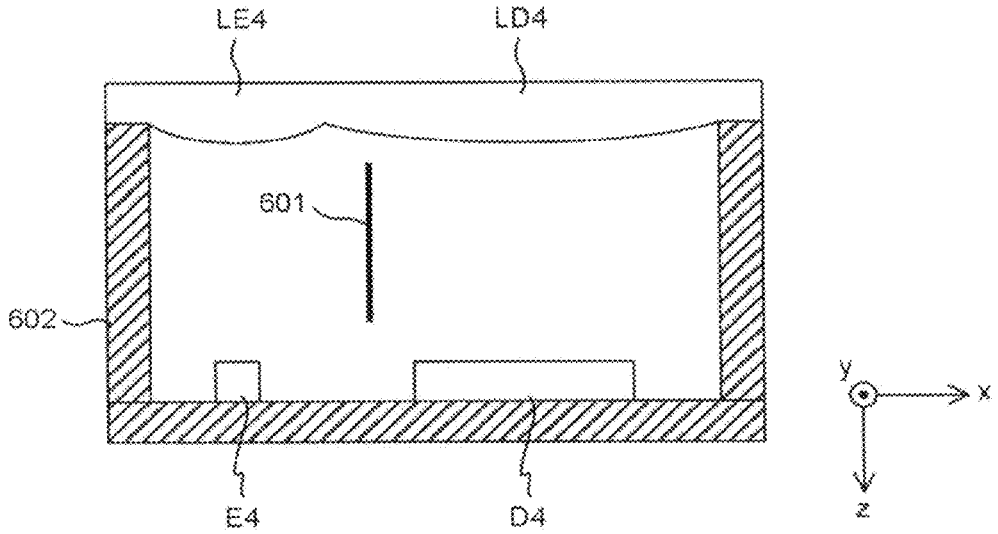
FIG. 7 is a third diagram for explaining the reflective optical sensor.
Figure 8:
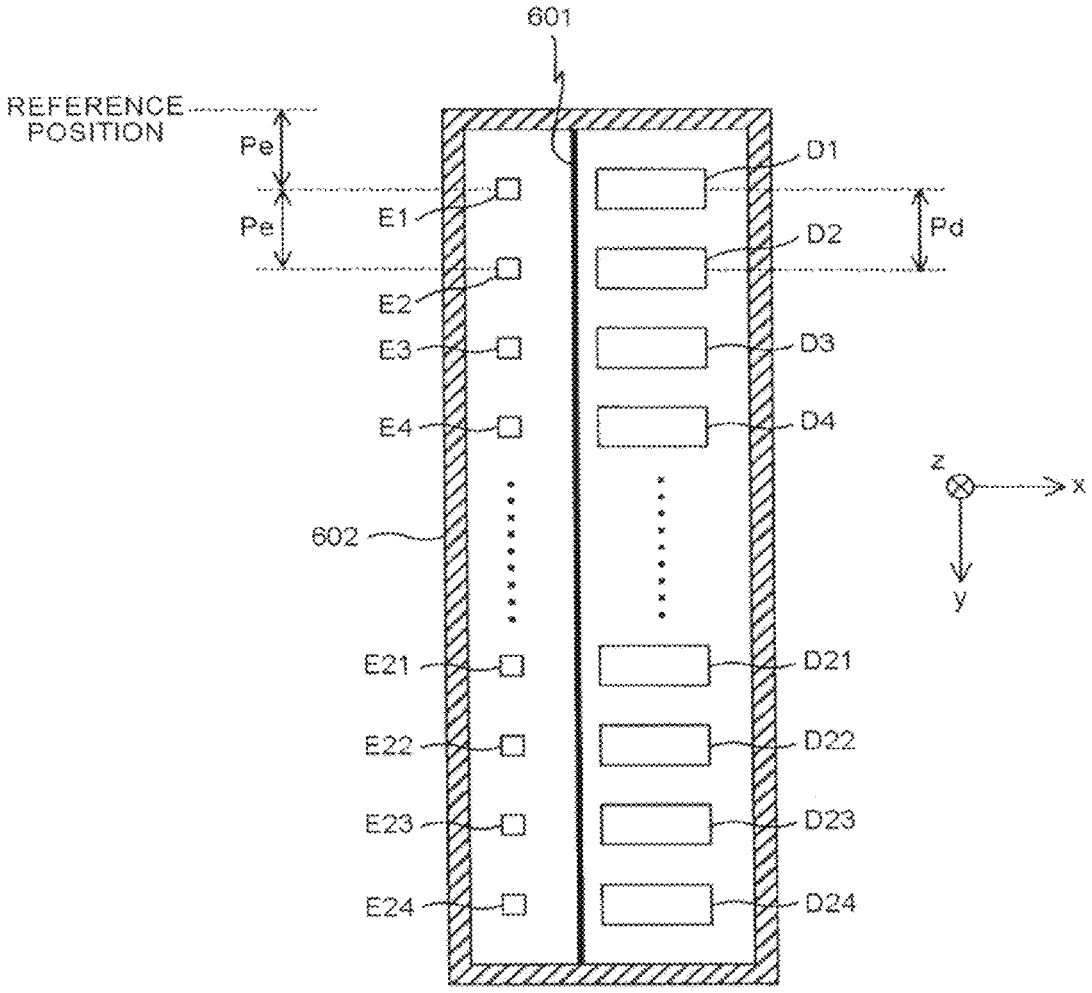
FIG. 8 is a fourth diagram for explaining the reflective optical sensor.

As illustrated in FIGS. 5 to 8 as an example, the reflective optical sensor 2245 includes an irradiation system including 24 light emitting units (E1 to E24), an illumination optical system including 24 microlenses for illumination (LE1 to LE 24), a light receiving optical system including 24 microlenses for receiving light (LD1 to LD24), a light receiving system including 24 light receiving units (D1 to D24), a light shield 601, a holding member 602 holding these components, and the like. FIG. 7 is an x-z cross-sectional view of the reflective optical sensor 2245, and FIG. 8 is an x-y cross-sectional view of the reflective optical sensor 2245.

The 24 light emitting units (E1 to E24) are arranged along the y-axis direction at regular intervals (center-to-center distances) Pe. Herein, Pe=1 mm as an example.

The light emitting unit at the most −y side is a light emitting unit E1 and the light emitting unit at the most +y side is a light emitting unit E24.

LEDs (light emitting diodes) can be used for the light emitting units. Light emitted from the light emitting units has a wavelength of 850 nm. In the following, a light emitting unit that is lit is also referred to as a "lit light emitting unit" for convenience sake.

The light emitting units are individually lit and individually turned off according to an instruction from the printer controller 2090.

The 24 microlenses for illumination (LE1 to LE24) are arranged along the y-axis direction at regular intervals (center-to-center distances), and are respectively associated with the 24 light emitting units (E1 to E24).

Each microlens for illumination guides light emitted from the associated light emitting unit to the surface of the fixing belt 502 in a light collecting manner. The microlenses for illumination have the same diameter, curvature radius, and thickness. Furthermore, the optical axis of each microlens for illumination is parallel to the direction (herein, the z-axis direction) perpendicular to the light emitting surface of the associated light emitting unit.

Each of the microlenses for illumination has a light-collecting power at the optical surface on the light incident side but does not have a light-collecting power at the optical surface on the light exiting side. The optical surface on the light incident side is a spherical surface having a light collecting function in the x-axis direction and the y-axis direction.

Figure 9:
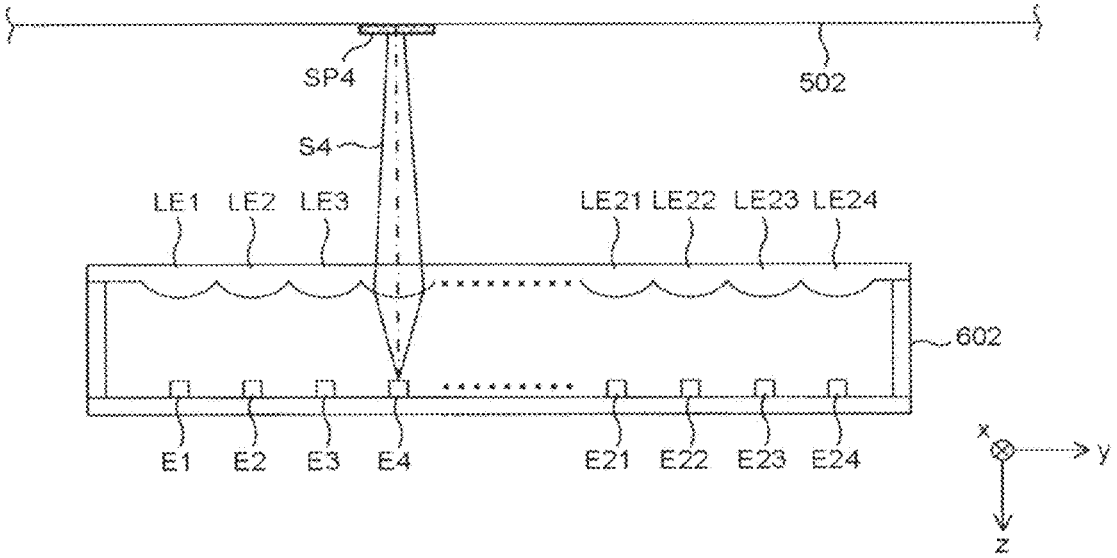
FIG. 9 is a first diagram for explaining detection light and a detection light spot.
Figure 10:
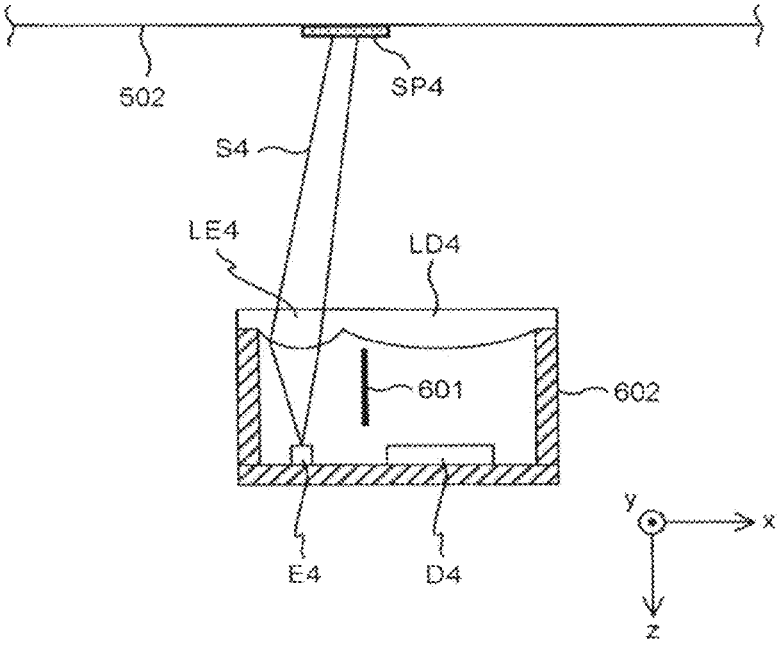
FIG. 10 is a second diagram for explaining the detection light and the detection light spot.

To make the description easier to understand, it is assumed here that only light having been emitted from the respective light emitting units and having passed through the associated microlenses for illumination illuminates the fixing belt 502 as detection light (S1 to S24) and forms detection light spots (SP1 to SP24) on the surface of the fixing belt 502 (see FIGS. 9 and 10).

The size (diameter) of each detection light spot is 1 mm, for example.

In the following, to avoid complication, an integer i of 1 to 24 will be used to express a light emitting unit as a "light emitting unit Ei" unless each light emitting unit needs to be identified. In addition, the microlens for illumination associated with the light emitting unit Ei will be expressed as a "microlens for illumination LEi". In addition, light having been emitted from the light emitting unit Ei and having passed through the microlens for illumination LEi will be expressed as "detection light Si".

Furthermore, a light spot formed on the surface of the fixing belt 502 by the detection light Si will be expressed as a "detection light spot SPi".

Herein, a position away from the light emitting unit E1 by a distance Pe in the −y direction is defined as a reference position. In addition, the center position of the detection light spot SPi in the y-axis direction when the reference position is 0 will be expressed as a "light irradiation position Ri". Thus, the light irradiation position R1 is Pe, the light irradiation position R2 is 2×Pe, the light irradiation position R3 is 3×Pe, . . . , and the light irradiation position R24 is 24×Pe.

Figure 11:
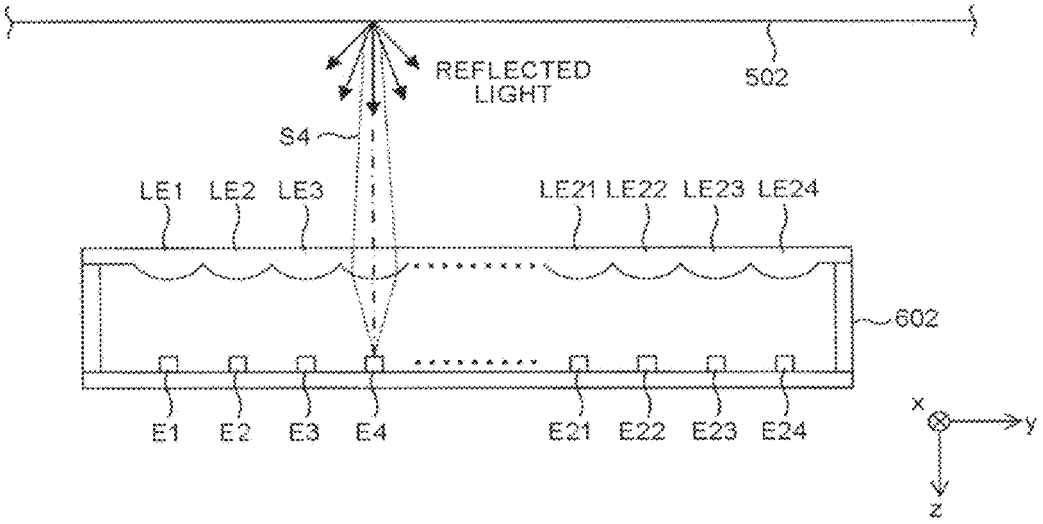
FIG. 11 is a diagram for explaining light (reflected light) reflected by a fixing belt.

The detection light with which the fixing belt 502 is irradiated is regularly reflected and diffusely reflected by the surface of the fixing belt 502 (see FIG. 11).

Referring back to FIG. 8, the 24 light receiving units (D1 to D24) are arranged along the y-axis direction at regular intervals (center-to-center distances) Pd. Herein, Pd=1 mm as an example. Each light receiving unit receives light reflected by the surface of the fixing belt 502.

Light having been emitted from the light emitting unit. E3 and reflected by the surface of the fixing belt 502 is set to be received by five light receiving units: the light receiving unit D1, the light receiving unit D2, the light receiving unit D3, the light receiving unit D4, and the light receiving unit D5.

Light having been emitted from the light emitting unit E4 and reflected by the surface of the fixing belt 502 is set to be received by five light receiving units: the light receiving unit D2, the light receiving unit D3, the light receiving unit D4, the light receiving unit D5, and the light receiving unit D6.

Light having been emitted from the light emitting unit E5 and reflected by the surface of the fixing belt 502 is set to be received by five light receiving units: the light receiving unit D3, the light receiving unit D4, the light receiving unit D5, the light receiving unit D6, and the light receiving unit D7.

Thus, light having been emitted from the light emitting unit Ei and reflected by the surface of the fixing belt 502 is set to be received by five light receiving units: the light receiving unit D(i−2), the light receiving unit D(i−1), the light receiving unit. Di, the light receiving unit D(i+1), and the light receiving unit D(i+2).

In the following, the five light receiving units of the light receiving unit. D(i−2), the light receiving unit D(i−1), the light receiving unit Di, the light receiving unit D(i+1), and the light receiving unit D(i+2) will also be referred to as the light receiving units associated with the light emitting unit Ei.

PDs (photodiodes) can be used for the light receiving units. Each of the light receiving units outputs a signal corresponding to the amount of light received. The output signal from each light receiving unit is sent to the printer controller 2090.

The 24 microlenses for receiving light (LD1 to LD24) are individually associated with the 24 light receiving units (Dl to D24), respectively, and collect light reflected by the surface of the fixing belt 502. In this case, the amount of light received by the light receiving units can be increased. Thus, detection sensitivity can be improved. The microlenses for receiving light have the same diameter, curvature radius, and thickness.

Each of the microlenses for receiving light has a light-collecting power at the optical surface on the light exiting side but does not have a light-collecting power at the optical surface on the light incident side. The optical surface on the light exiting side is a cylindrical surface having a light collecting function in the x-axis direction but having no light collecting function in the y-axis direction.

In the present embodiment, the microlenses are made of resin, and the 24 microlenses for illumination (LE1 to LE24) and the 24 microlenses for receiving light (LD1 to LD24) are integrally formed as a microlens array. In this case, the workability in attaching the microlenses at predetermined positions can be improved. Furthermore, the accuracy of relative positions of lens surfaces of the microlenses can be improved.

The light shield 601 is arranged between the irradiation system and the light receiving system, and prevents flare light from being received by the light receiving units. Herein, a plate member made of resin is used for the light shield 601.

The holding member 602 includes a plate member holding the irradiation system and the light receiving system, and a plate member holding the illumination optical system, the light receiving optical system and the light shield 601. Herein, plate members made of resin are used for the plate members.

The holding member 602 and the microlens array may be formed integrally if these are made of the same material. Furthermore, the holding member 602 and the light shield 601 may be formed integrally if these are made of the same material.

Referring back to FIG. 4, the heat shielding member 100 is arranged between the fixing belt 502 and the reflective optical sensor 2245 in the z-axis direction.

Figure 12:
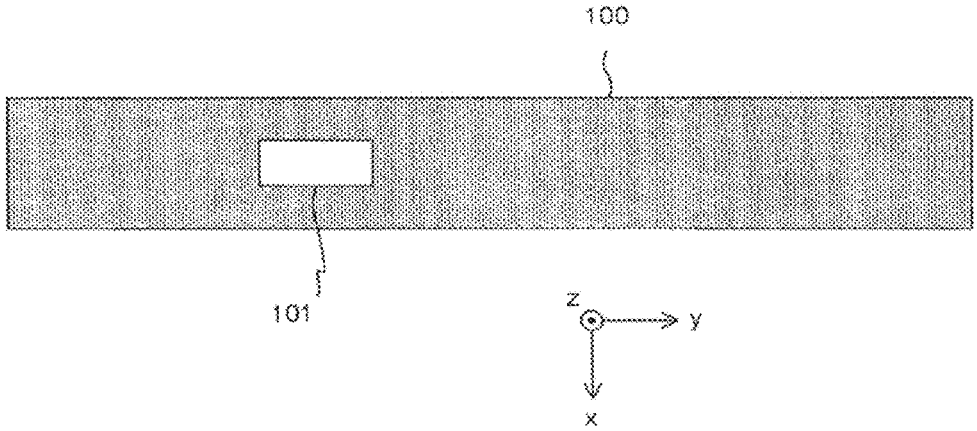
FIG. 12 is a diagram for explaining a heat shielding member.
Figure 13:
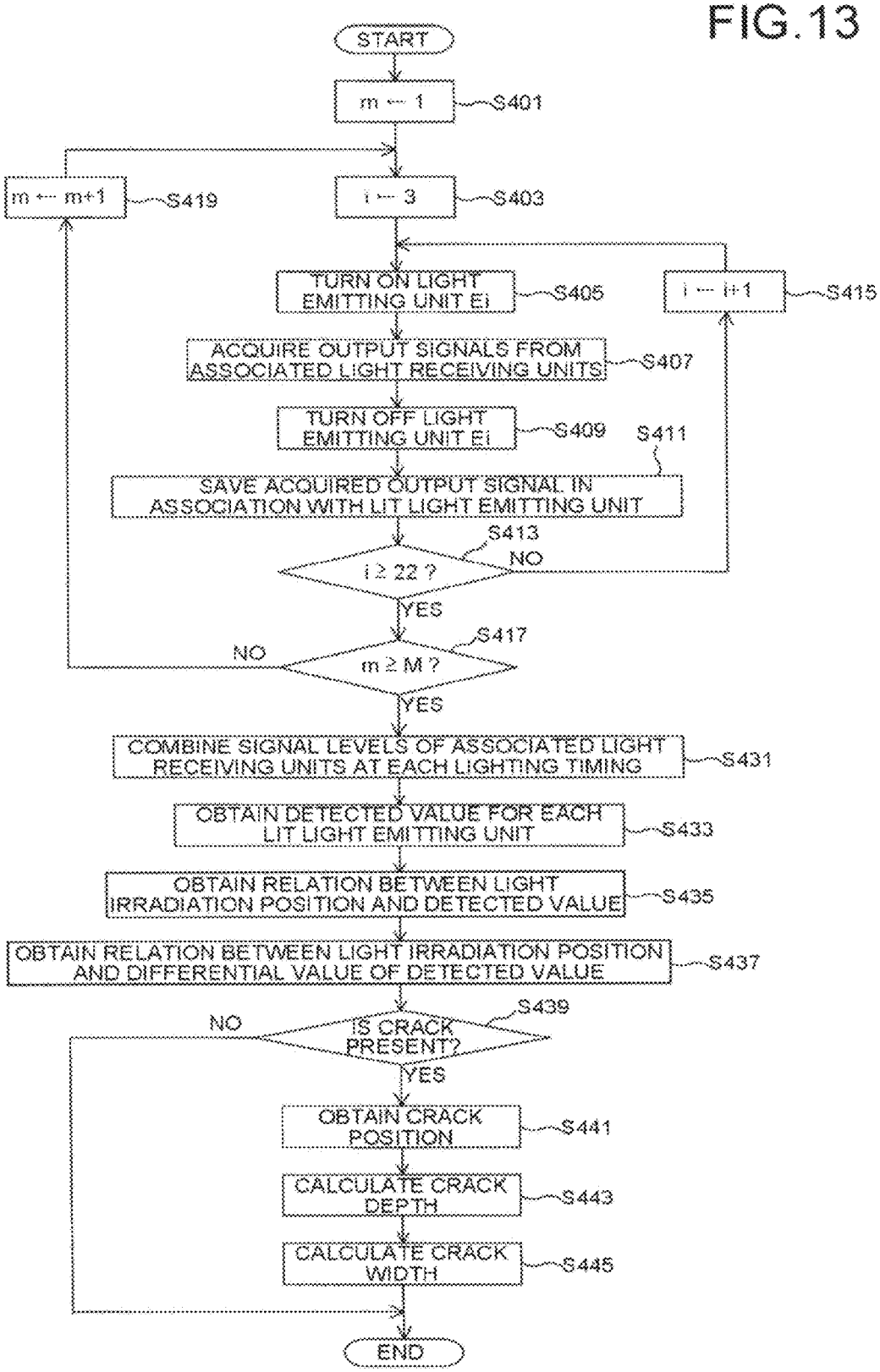
FIG. 13 is a flowchart for explaining a surface state checking process.

The heat shielding member 100 is a member for preventing the reflective optical sensor 2245 from being affected by the heat from the heating roller 504, and includes a light passing part 101 through which light emitted from the reflective optical sensor 2245 and directed to the fixing belt 502 and light reflected by the fixing belt 502 and directed to the reflective optical sensor 2245 can pass as illustrated in FIG. 12, for example.

The length of the heat shielding member 100 in the y-axis direction is set to be substantially equal to or a little longer than that of the heating roller 504 in the y-axis direction.

An opaque engineering plastic having heat resistance or metal can be used as the material of the heat shielding member 100.

The light passing part 101 may be an opening or an opening covered with a transparent engineering plastic plate or glass plate having heat resistance.

Before printing on A4 recording paper in the landscape direction or printing on A3 recording paper after printing on a predetermined number of sheets (500 sheets, for example) of A4 recording paper in the portrait direction, the printer controller 2090 checks the surface state of the fixing belt 502 by using the reflective optical sensor 2245. The surface state checking process will be described with reference to FIG. 13. A flowchart of FIG. 13 corresponds to a series of processing algorithms executed by the printer controller 2090 for the surface state checking process.

First, in step S401, a variable m representing the number of times of repetition is set to an initial value 1.

Subsequently, in step S403, a variable i representing a lit light emitting unit is set to an initial value 3.

Subsequently, in step S405, the light emitting unit Ei is turned on.

Subsequently, in step S407, output signals from the light receiving unit D(i−2), the light receiving unit D(i−1), the light receiving unit Di, the light receiving unit D(i+1), and the light receiving unit D(i+2) that are light receiving units associated with the light emitting unit Ei are acquired.

Subsequently, in step S409, the light emitting unit Ei is turned off.

Subsequently, in step S411, the output signals from the light receiving units associated with the light emitting unit Ei are saved in association with the light emitting unit Ei in the RAM of the printer controller 2090.

Subsequently, in step S413, it is determined whether or not the value of i is 22 or larger. If the value of i is not 22 or larger, the determination here is negative, and the process proceeds to step S415.

In step S415, the value of i is incremented by +1 and the process returns to step S405 described above.

Subsequently, the processing from step S405 to step S415 is repeated until the determination in step S413 becomes positive.

When the value of i becomes 22, the determination in step S413 becomes positive and the process proceeds to step S417.

In step S417, it is determined whether or not the value of m is a preset integer (M≥2) or larger. If the value of m is not M or larger, the determination here is negative, and the process proceeds to step S419.

In step S419, the value of m is incremented by +1 and the process returns to step S403 described above.

Subsequently, the processing from step S403 to step S419 is repeated until the determination in step S417 becomes positive.

When the value of m becomes M, the determination in step S417 becomes positive and the process proceeds to step S431.

In step S431, the total value (hereinafter also referred to as a "combined level value") of the levels of the output signals from the light receiving units associated with the lit light emitting unit, that is, the five light receiving units at each lighting timing saved in the RAM is obtained. Herein, M combined level values are obtained for each lit light emitting units.

Subsequently, in step S433, any of an average value of the obtained M combined level values, a median value of the obtained M combined level values, an average value of the combined level values excluding outliers, and a media value of the combined level values excluding outliers as a detected value for each lit light emitting unit (see FIG. 14). Note that the unit of the detected value is an arbitrary unit (a.u.).

Figure 14:
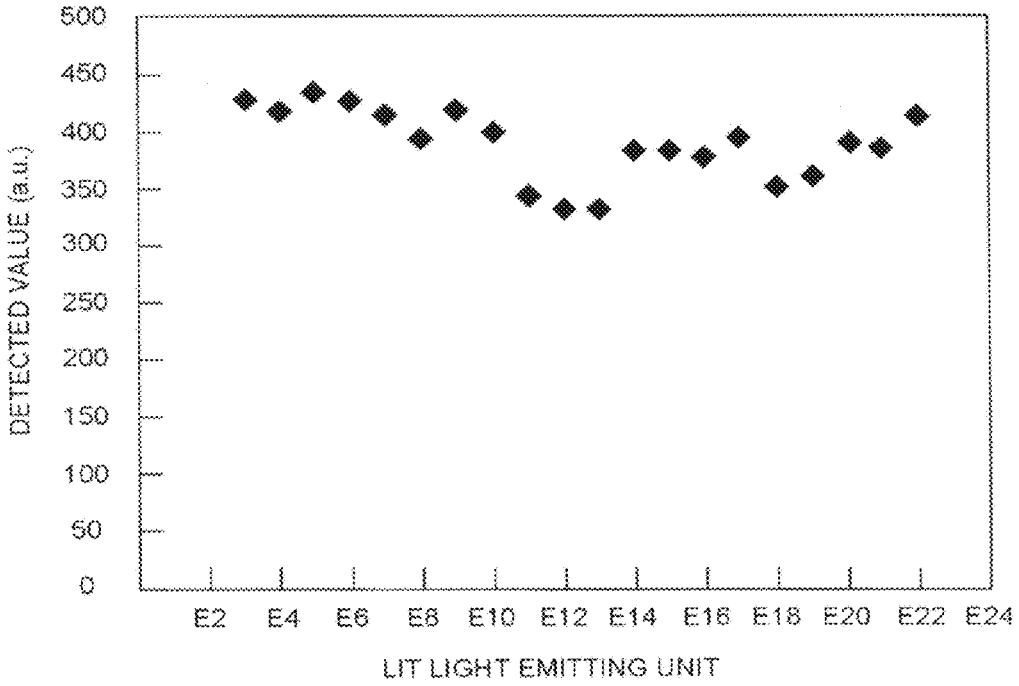
FIG. 14 is a graph for explaining the relation between a detected value and a lit light emitting unit.
Figure 15:
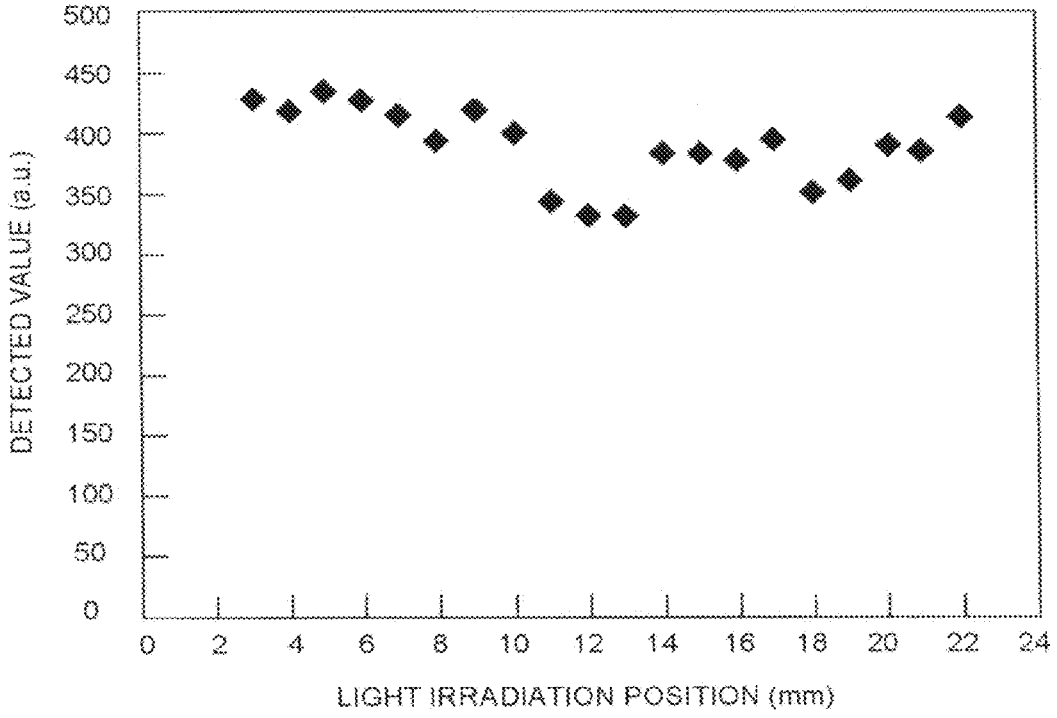
FIG. 15 is a graph for explaining the relation between a detected value and a light irradiation position.
Figure 16:
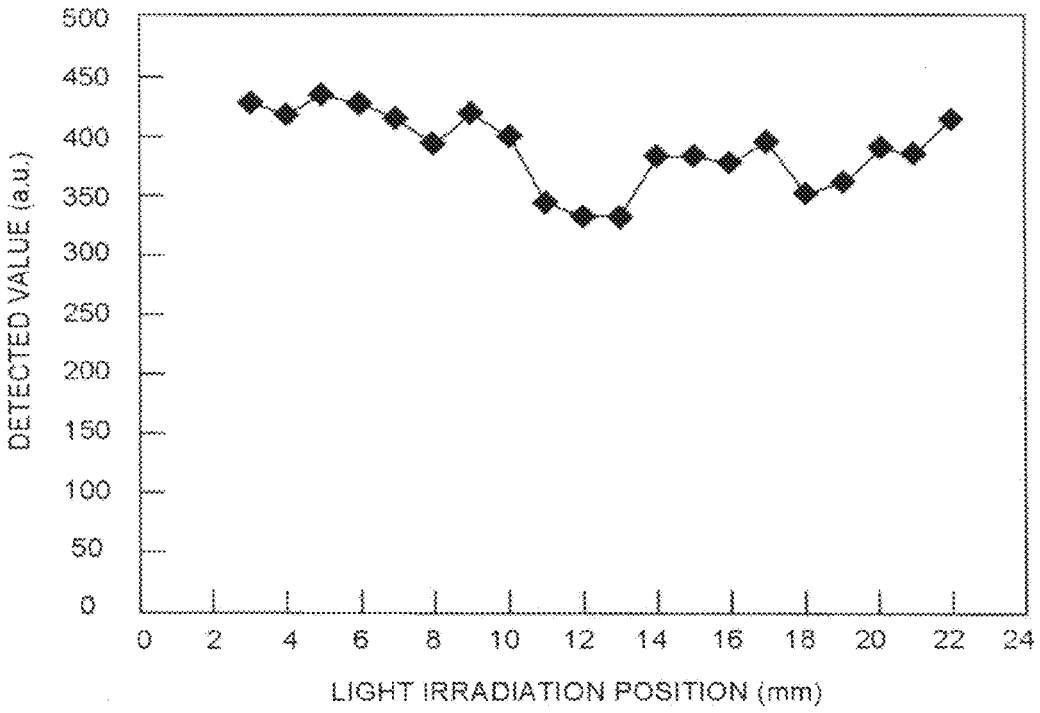
FIG. 16 is a graph for explaining a method for obtaining a differential value.
Figure 17:
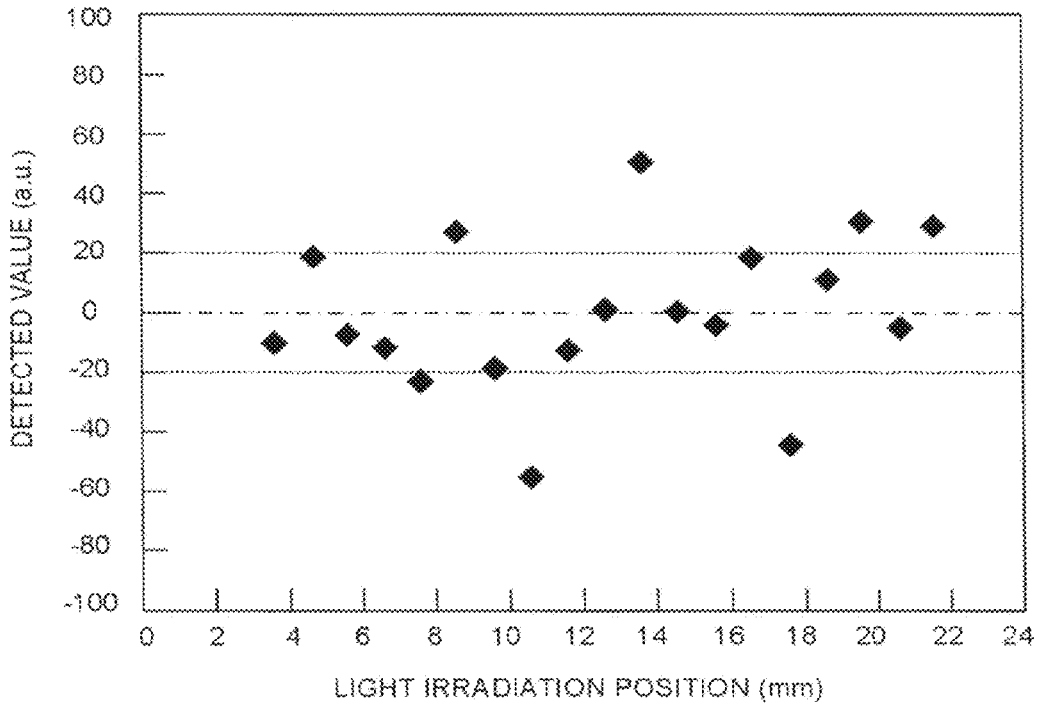
FIG. 17 is a graph for explaining the relation between the differential value and the light irradiation position.

Subsequently, in step S435, the lit light emitting units in FIG. 14 are converted to light irradiation positions, and the relation between a light irradiation position and the detected value is obtained (see FIG. 15).

Subsequently, in step S437, for all the detected values, detected values at two light irradiation positions adjacent to each other in the y-axis direction are connected by a straight line (see FIG. 16) and the slope of thereof is defined as a differential value at the middle point of the two light irradiation positions. The relation between a light irradiation position and the differential value is then obtained (see FIG. 17).

Subsequently, in step S439, it is determined whether or not a crack is present. Here, if there is a differential value with an absolute number exceeding 20 (a.u.), it is determined that a crack is present and the process proceeds to the next step S441.

Figure 18:
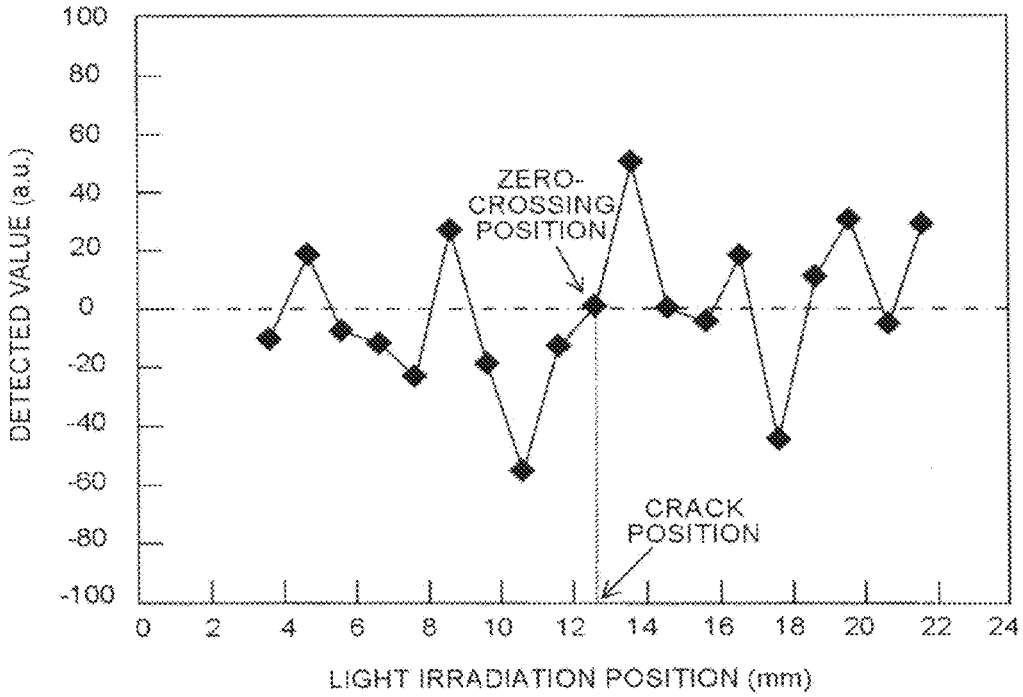
FIG. 18 is a graph for explaining a zero-crossing position.

In step S441, the position of the crack is obtained. Here, a position where the differential value is 0 (a.u.) when the differential value varies from a value smaller than −20 (a.u.) to a value larger than +20 (a.u.), that is, a zero-crossing position is obtained (see FIG. 18). The light irradiation position corresponding to the zero-crossing position is the position of a crack. In FIG. 18, it is determined that a crack is present at a position of 12.5 mm.

Subsequently, in step S443, the depth of the crack is obtained. Note that the decrease in the intensity of reflected light received by the light receiving units is assumed to be larger as the depth of the crack is larger. Thus, the amount of decrease in the reflected light intensity is associated with the depth of the crack.

The depth of the crack may thus be obtained from the detected value at the position of the crack, but the slope component may be superimposed on the relation between a light irradiation position and the detected value owing to an attachment error of the reflective optical sensor 2245, the inclination of the fixing belt 502, or the like.

Figure 19:
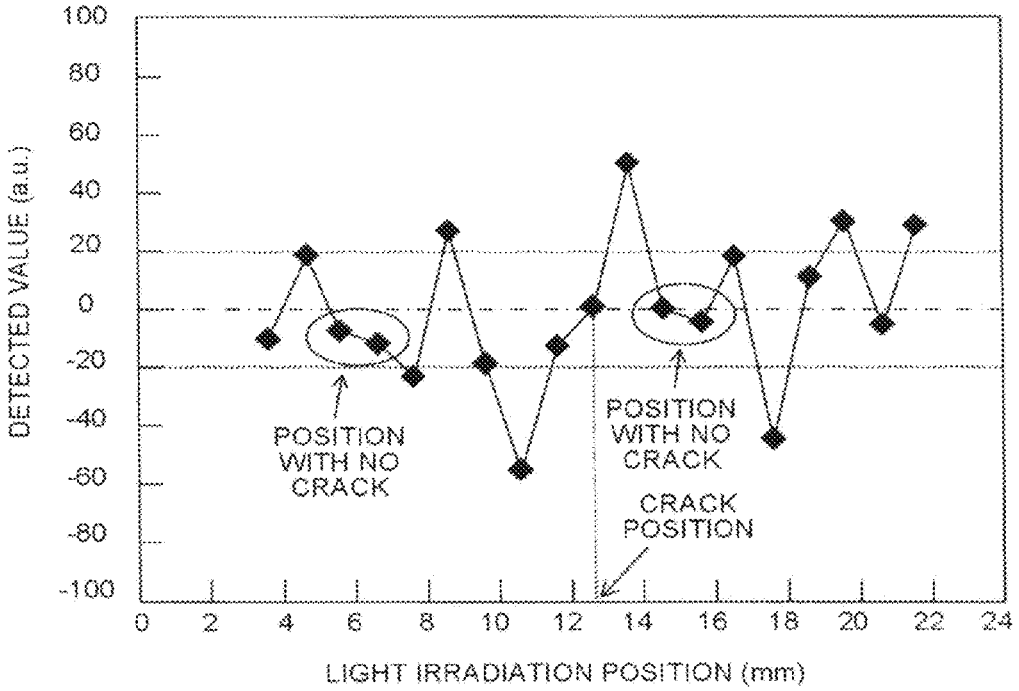
FIG. 19 is a first graph for explaining a method for obtaining the depth of a crack.

In this case, the relation between the light irradiation position and the differential value is first referred to, and light irradiation positions where there is clearly no crack on the −y side and on the +y side of the crack position are obtained (see FIG. 19). In FIG. 19, it is clear that the differential values are close to 0 and that there is no crack at the light irradiation positions of 6 mm and 15 mm.

Figure 20:
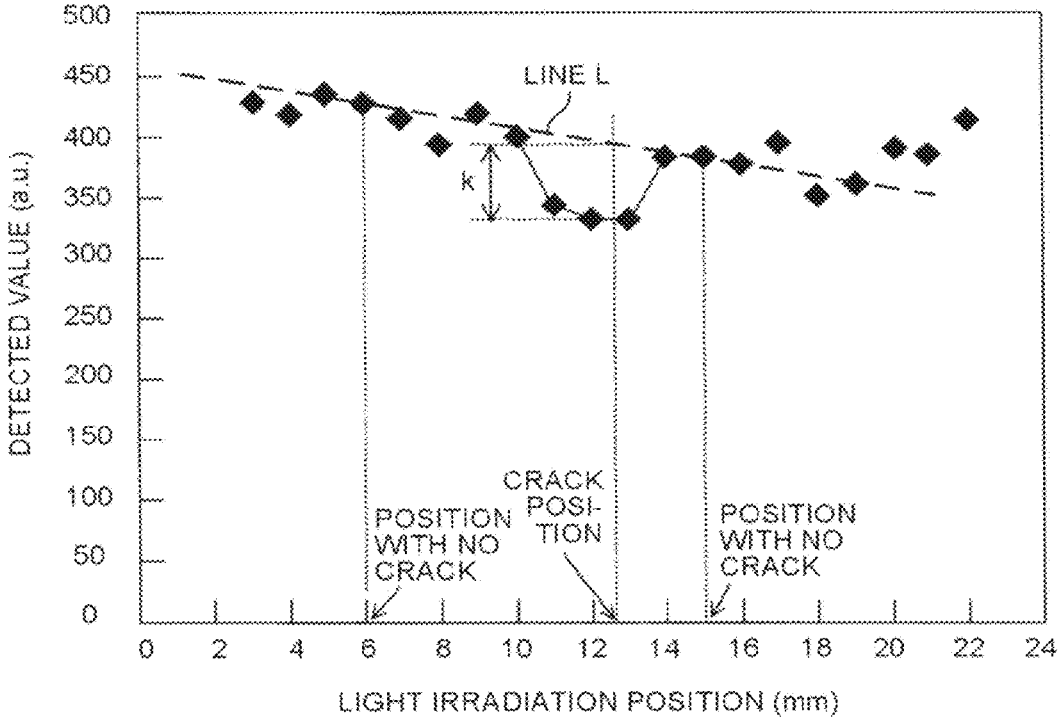
FIG. 20 is a second graph for explaining a method for obtaining the depth of a crack.

Subsequently, in the relations of the light irradiation positions and the detected values, the detected values at the two light irradiation positions where there is clearly no crack are connected by a line L (see FIG. 20). The slope of the line L corresponds to the slope component.

Subsequently, an average value of two detected values on both sides of the crack position, or a smaller value of the two is defined as a detected value at the crack position.

Subsequently, a difference k between the value of the line L at the crack position and the detected value at the crack position is calculated (see FIG. 20). In FIG. 20, k corresponds to a decrease rate of the reflected light intensity of about 16%.

Subsequently, the relation between the value of k and the crack depth obtained in advance by experiments or the like and stored in the ROM is referred to, and the crack depth is obtained from the calculated k.

Figure 21:
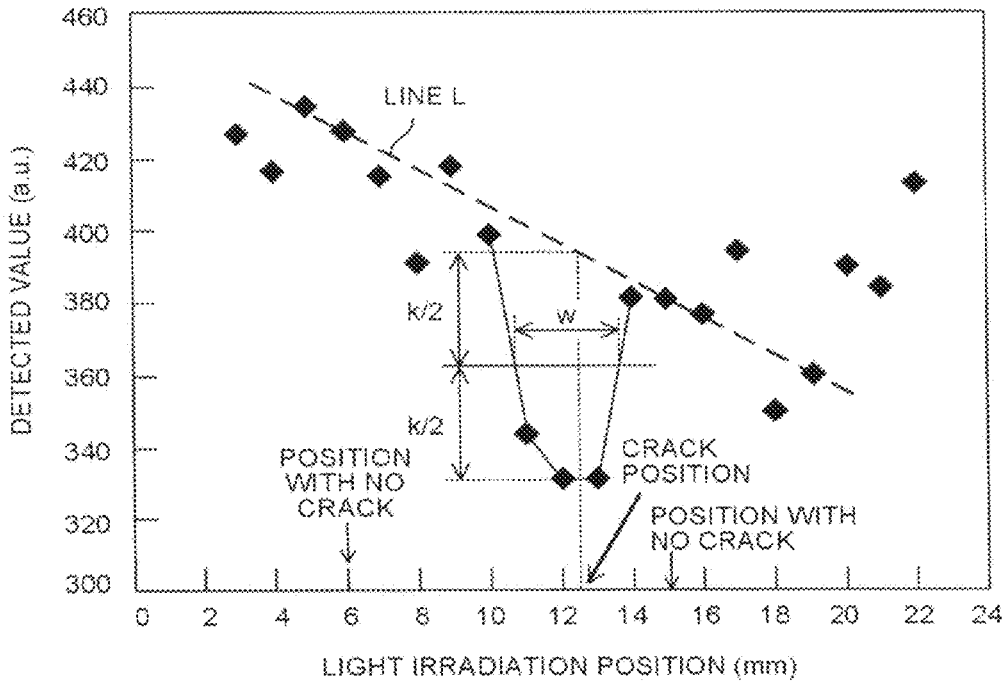
FIG. 21 is a graph for explaining a method for obtaining the width of a crack.

Subsequently, in step S445, the width of the crack is obtained. Herein, the width at the light irradiation position corresponding to k/2 is defined as a width w of the crack (see FIG. 21). In FIG. 21, the width w of the crack is about 3 mm. The surface state checking process is then terminated.

If the absolute values of all the differential values are smaller than 20 (a.u.) in step S439 described above, it is determined that no crack is present and the surface state checking process is terminated.

In the present embodiment, since the heat shielding member 100 is arranged between the heating roller 504 and the reflective optical sensor 2245 to prevent the reflective optical sensor 2245 from being affected by the heat from the heating roller 504, a crack position, the depth of the crack, and the width of the crack of the fixing belt 502 can be obtained with high accuracy.

If at least one of the crack depth and the crack width exceeds a preset threshold therefor, the printer controller 2090 displays the crack position, the crack depth, and the crack width together with a message indicating that a crack is present in the surface of the fixing belt 502 on the display of the operation panel. The operator informs a maintenance provider of the details displayed on the display. Alternatively, the maintenance provider may be automatically informed of the information via a public line from the color printer 2000.

The maintenance provider smoothes away the surface of the fixing belt 502 according to the crack position, the crack depth and the crack width. In this case, since the crack position, the crack depth and the crack width are obtained with high accuracy, lack of smoothing or excessive smoothing can be prevented. Thus, maintenance of the fixing belt 502 can be properly conducted.

The printer controller 2090 can therefore stably form good quality images.

As described above, the color printer 2000 according to the present embodiment includes the optical scanning device 2010, four image forming stations, the intermediate transfer belt 2040, the secondary transfer roller 2042, the fixing device 2050, the reflective optical sensor 2245, the heat shielding member 100, the operation panel, the printer controller 2090, and the like.

The reflective optical sensor 2245 includes 24 light emitting units (E1 to E24) that are arranged at regular intervals Pe along the y-axis direction and emit light toward the fixing belt 502, 24 light receiving units (Dl to D24) that receive light reflected by the fixing belt 502, and the like.

The heat shielding member 100 is arranged between the fixing belt 502 and the reflective optical sensor 2245 in the z-axis direction, includes the light passing part 101 through which light directed to the fixing belt 502 from the reflective optical sensor 2245 and light reflected by the fixing belt 502 and directed to the reflective optical sensor 2245 can pass, and prevents heat transfer from the heating roller 504 to the reflective optical sensor 2245.

In this case, the printer controller 2090 can obtain a crack position of the fixing belt 502, the crack depth, and the crack width on the basis of an output signal from the reflective optical sensor 2245 with higher accuracy than the related art.

As a result, maintenance of the fixing belt 502 can be properly conducted, and the color printer 2000 can stably form good quality images.

Although a case in which the length in the y-axis direction of the heat shielding member 100 is set to be substantially equal to or a little longer than the length in the v-axis direction of the heating roller 504 is described in the embodiment, the length is not limited thereto.

Figure 22:
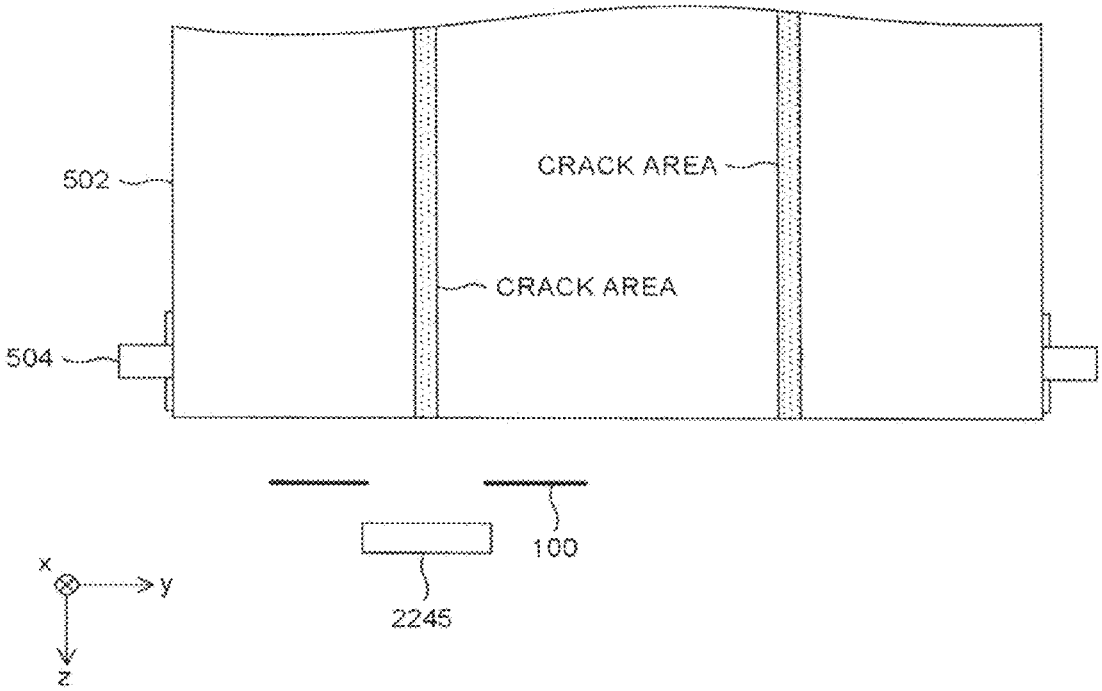
FIG. 22 is a diagram for explaining a modified example 1 of the heat shielding member.

For example, when the calorific value of the heating roller 504 is not very large, the length in the y-axis direction of the heat shielding member 100 may be smaller than that in the embodiment as illustrated in FIG. 22, for example.

Figure 23:
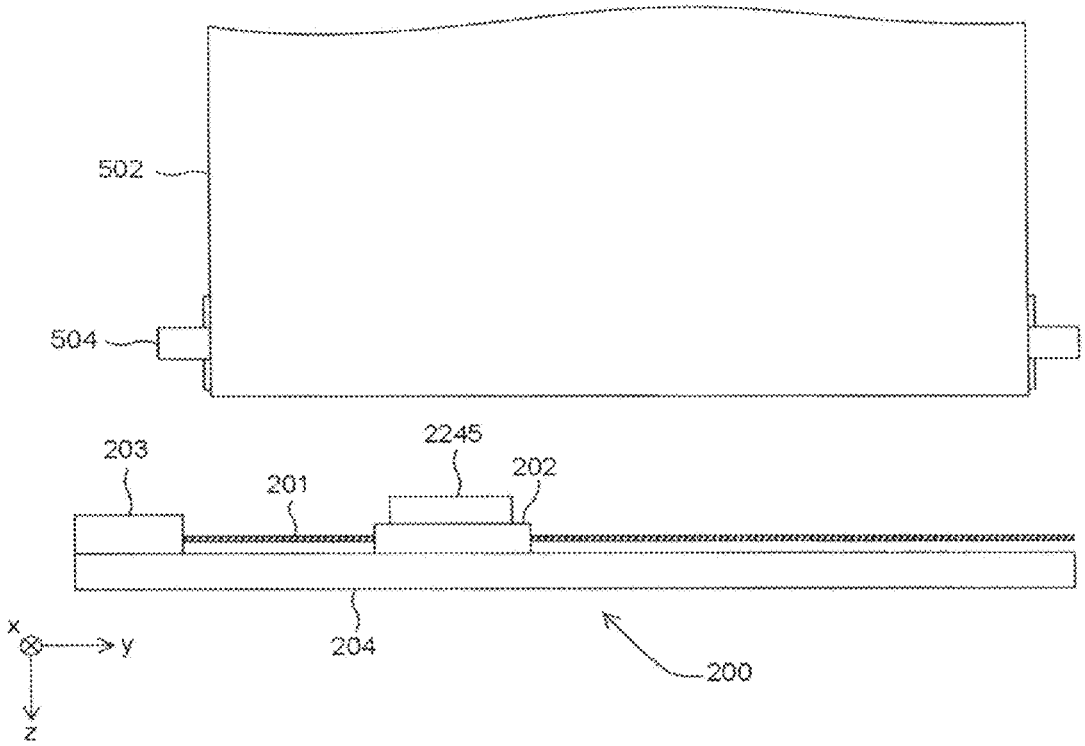
FIG. 23 is a diagram for explaining a drive mechanism.

Furthermore, in the embodiment described above, a drive mechanism 200 for moving the reflective optical sensor 2245 in the y-axis direction may be provided as illustrated in FIG. 23, for example. In this case, the embodiment can be used for multiple types of devices having different crack areas to be detected, for a type of devices in which a crack area to be detected varies, and for a type of devices in which a crack area to be detected is not clear, which can improve versatility.

The drive mechanism 200 includes a shaft 201 with the longitudinal direction along the y-axis direction, a through-hole into which the shaft 201 is screwed, a moving member 202 that moves along the y-axis direction with the rotation of the shaft 201, a motor 203 that rotates the shaft 201, a stage 204 on which the moving member 202 is placed, and the like. The reflective optical sensor 2245 is fixed to the moving member 202.

Figure 24:
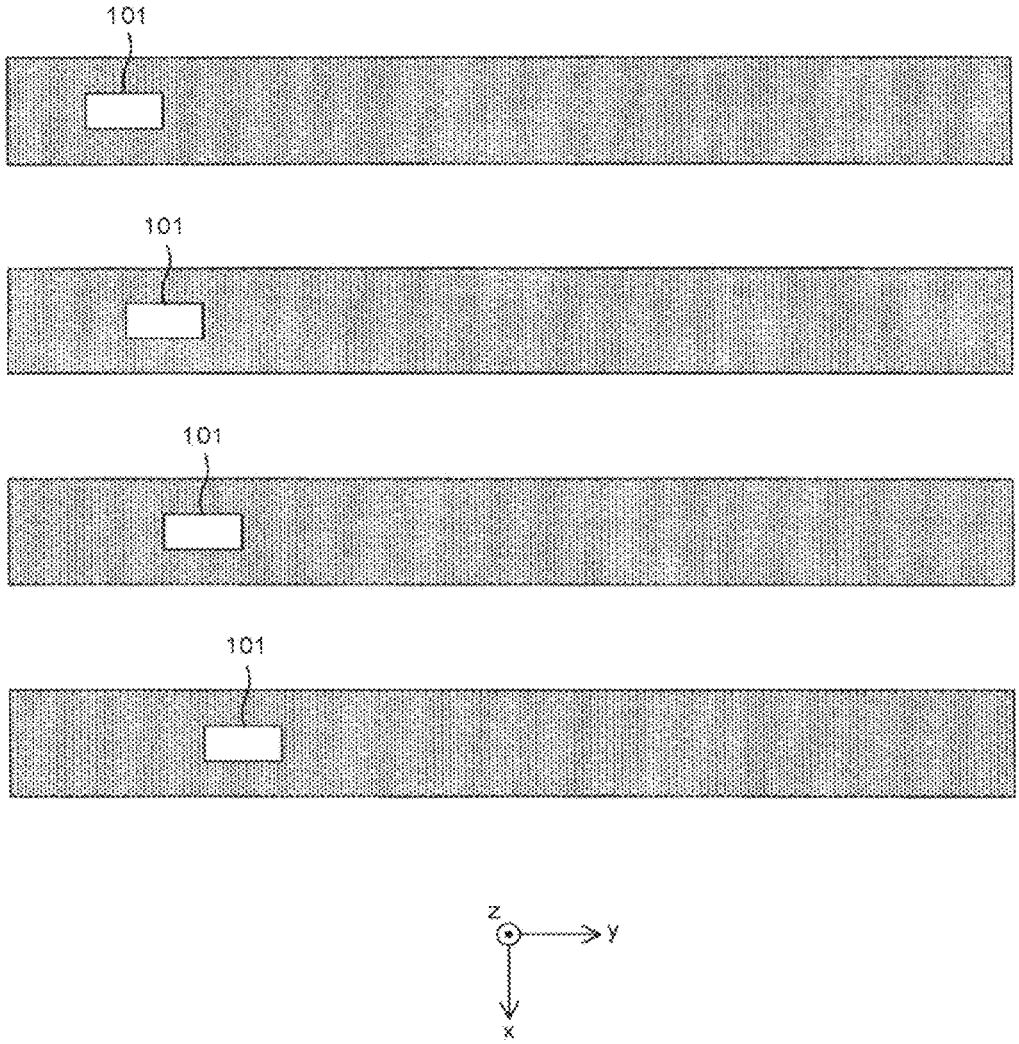
FIG. 24 is a diagram for explaining a modified example 2 of the heat shielding member.

In this case, as illustrated in FIG. 24, for examples, multiple heat shielding members each having a light passing part 101 in the y-axis direction at different positions from one another may be provided, and a heat shielding member suitable for the position in the y-axis direction of the reflective optical sensor 2245 may be selected.

Figure 25:
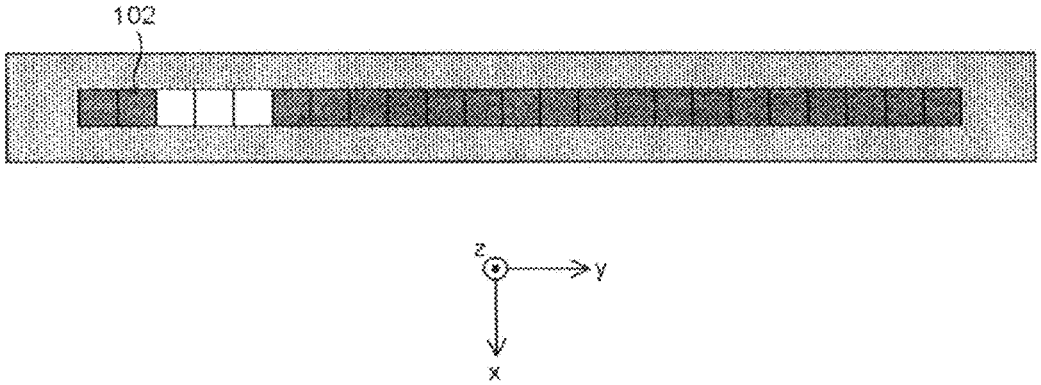
FIG. 25 is a diagram for explaining a modified example 3 of the heat shielding member.

Furthermore, in this case, as illustrated in FIG. 25, for example, a liquid crystal shutter array in which multiple liquid crystal shutters 102 are arranged along the y-axis direction may be used, and only liquid crystal shutters suitable for the position in the y-axis direction of the reflective optical sensor 2245 may be set into an open state. Alternatively, mechanical shutters may be used instead of liquid crystal shutters.

Figure 26:
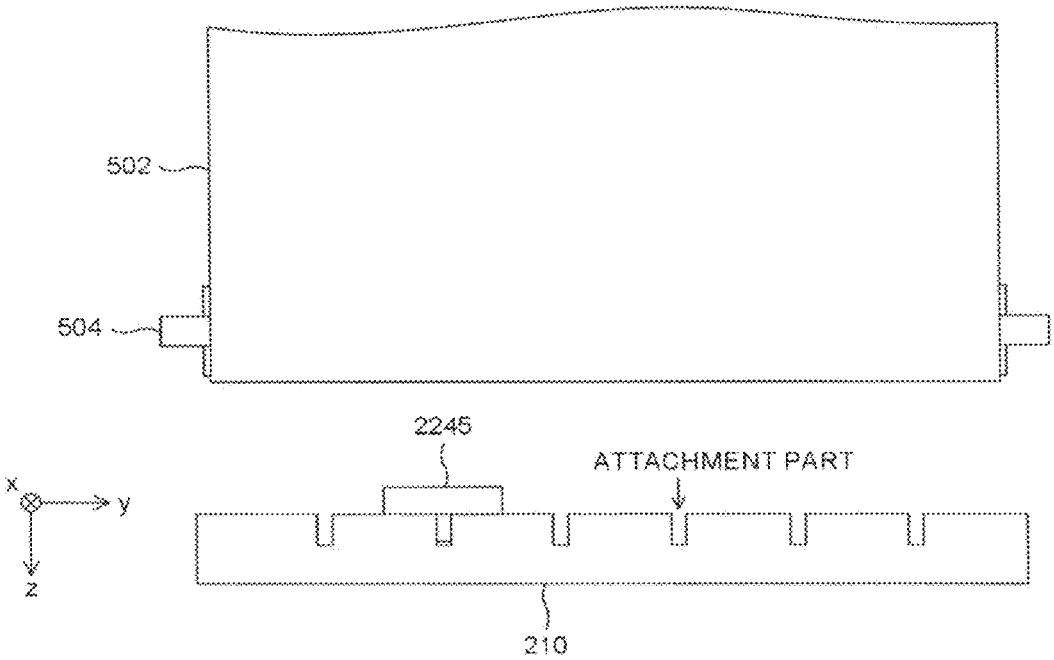
FIG. 26 is a diagram for explaining a stay.

Furthermore, in the embodiment described above, as illustrated in FIG. 26, for example, a stay 210 having multiple attachment part for the reflective optical sensor 2245 in the y-axis direction may be used to manually adjust the position in the y-axis direction of the reflective optical sensor 2245.

Figure 27:
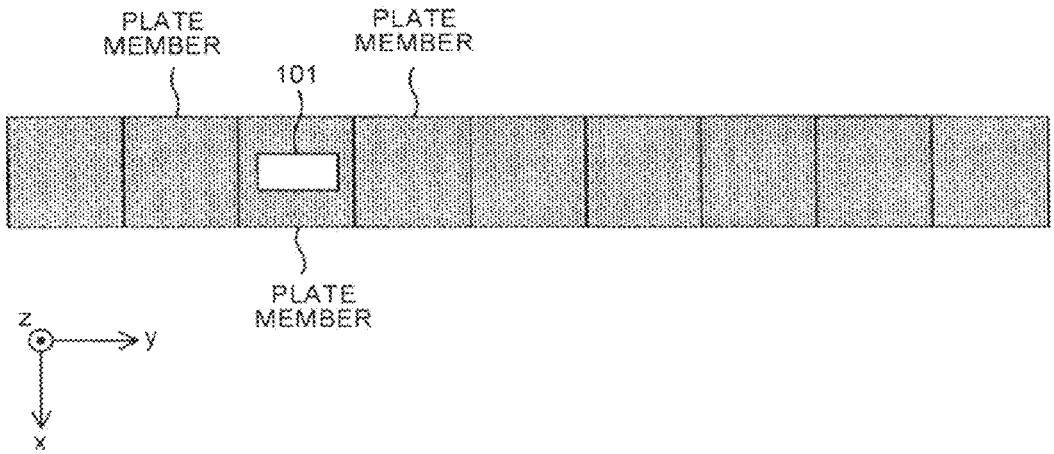
FIG. 27 is a diagram for explaining a modified example 4 of the heat shielding member.

In this case, as illustrated in FIG. 27, for example, a heat shielding member may be constituted by multiple removable plate members, only one of which is provided with a light passing part 101, and the plate member having the light passing part 101 may be attached to a proper position associated with the position in the y-axis direction of the reflective optical sensor 2245.

Furthermore, although a case in which multiple light emitting units are arranged along the y-axis direction is described in the embodiment, the light emitting units are not limited thereto, and may be arranged along a direction inclined with respect to the y-axis direction.

Figure 28:
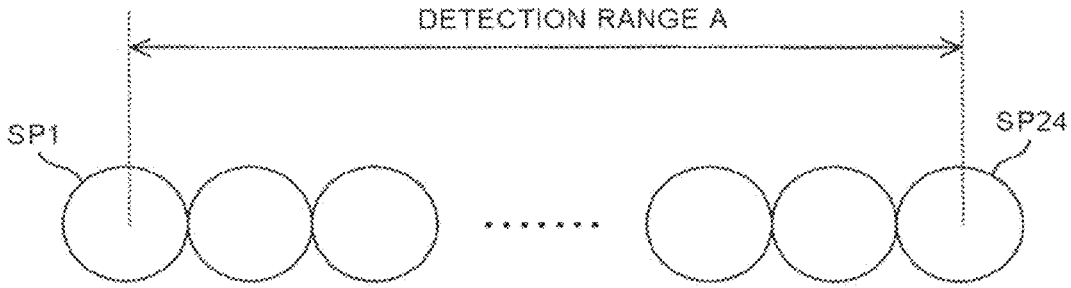
FIG. 28 is a diagram for explaining a modified example of a posture in which the reflective optical sensor is attached.
Figure 28:
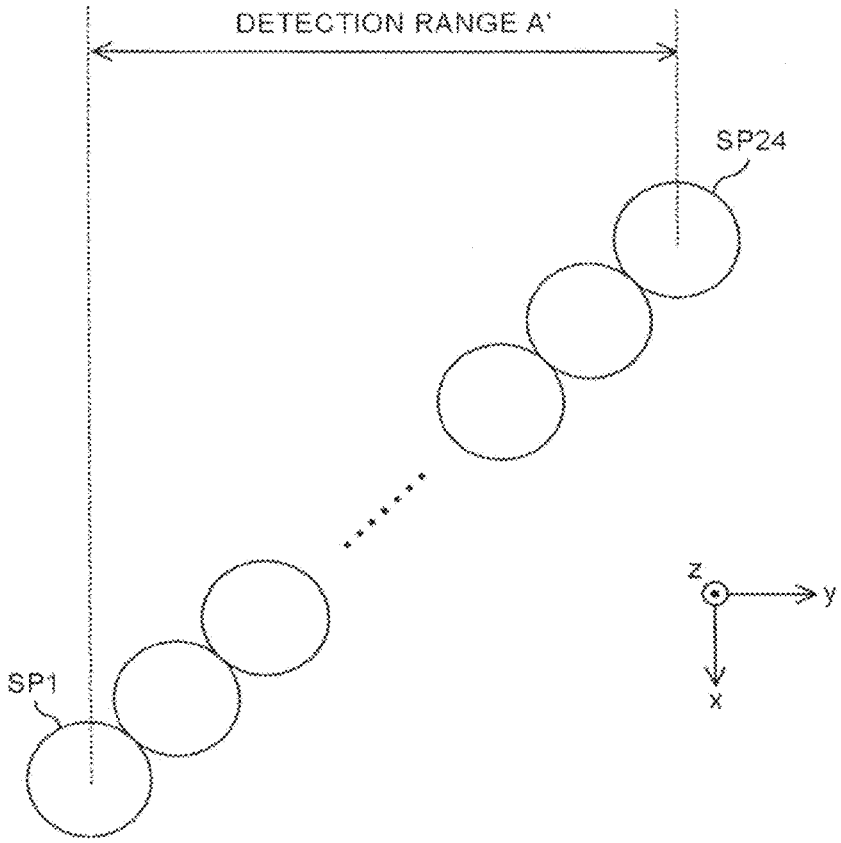

For example, as illustrated in FIG. 28, when a detection range in the case in which multiple light emitting units are arranged along the y-axis direction is represented by A and a detection range in the case in which multiple light emitting units are arranged along the direction inclined at 45° with respect to the y-axis direction is represented by A', the detection range A' is $1/\sqrt{2}$ times as small as the detection range A but can have higher position resolution in obtaining a crack position and the state of the crack (the crack depth, the crack width) of the fixing belt 502.

Furthermore, although a case in which the number of light emitting units and the number of light receiving units are 24 is described in the embodiment, the numbers are not limited thereto.

Furthermore, although a case in which the number of light emitting units and the number of light receiving units are equal is described in the embodiment, the numbers are not limited thereto, and the number of light receiving units may be larger than that of the light emitting units.

Furthermore, although a case in which five light receiving units, which are the light receiving unit D(i−2), the light receiving unit D(i−1), the light receiving unit Di, the light receiving unit D(i+1), and the light receiving unit D(i+2), are associated with a light emitting unit Ei is described in the embodiment, the light receiving units are not limited thereto.

For example, three light receiving units, which are the light receiving unit D(i−1), the light receiving unit Di, and the light receiving unit D(i+1), may be associated with a light emitting unit Ei.

Furthermore, although a case in which the light emitting unit E3 to the light emitting unit E22 are used for the surface state checking process is described in the embodiment, the surface state checking process is not limited thereto. For example, when a crack is expected near the light irradiation position R13, the light emitting unit E8 to the light emitting unit E18 may be used.

Furthermore, although a case in which 24 microlenses for illumination (LE1 to LE24) and 24 microlenses for receiving light (LD1 to LD24) are integrally formed is described in the embodiment, the microlenses are not limited thereto.

Furthermore, in the embodiment described above, the reflective optical sensor 2245 may be provided with a processor, and the processor may perform at least part of processing at the printer controller 2090 in the surface state checking process.

Figure 29:
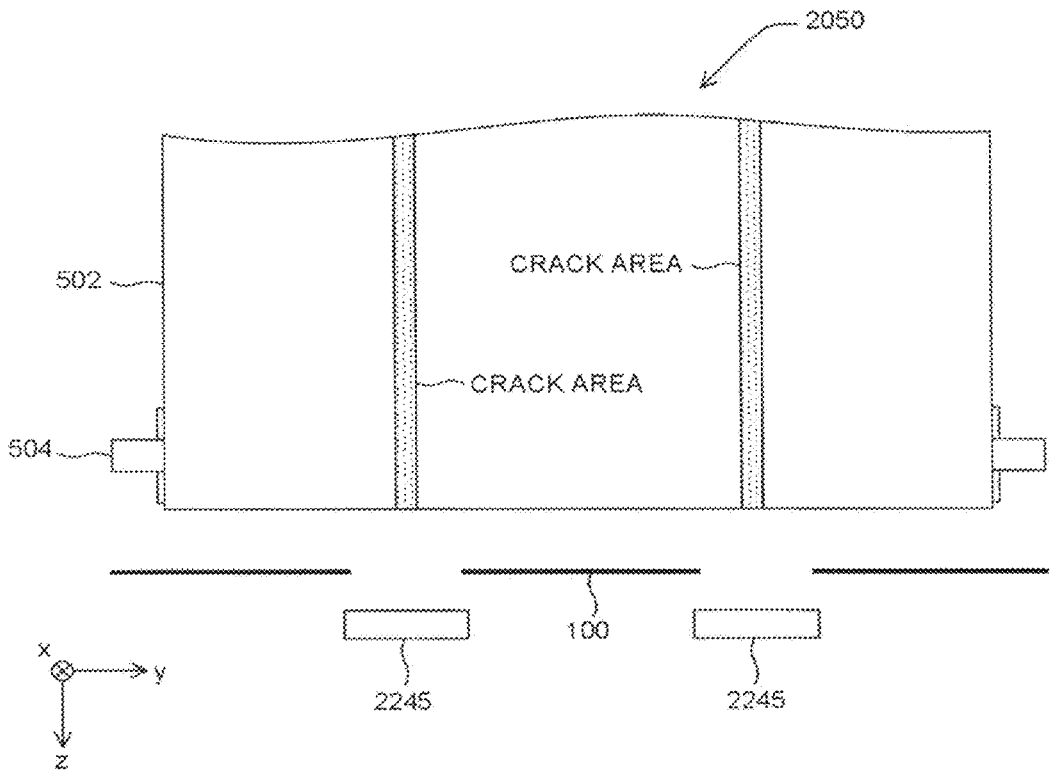
FIG. 29 is a diagram for explaining a case in which two reflective optical sensors are provided.

Furthermore, although a case in which one reflective optical sensor 2245 is provided is described in the embodiment, the reflective optical sensor is not limited thereto, and multiple reflective optical sensors 2245 may be provided (see FIG. 29).

Furthermore, although a case of a tandem multicolor printer configured to form full-color images by combining four colors (black, cyan, magenta, and yellow) is described as an image forming apparatus in the embodiment, the image forming apparatus is not limited thereto. For example, a multicolor printer further using auxiliary colors may be used, or a printer configured to form a monochrome image may be used.

Furthermore, a case of a color printer is described as an image forming apparatus in the embodiment, the image forming apparatus is not limited thereto, and may be an image forming apparatus other than a printer such as a copying machine, a facsimile machine, or a multifunction peripheral incorporating these machines.

Figure 30:
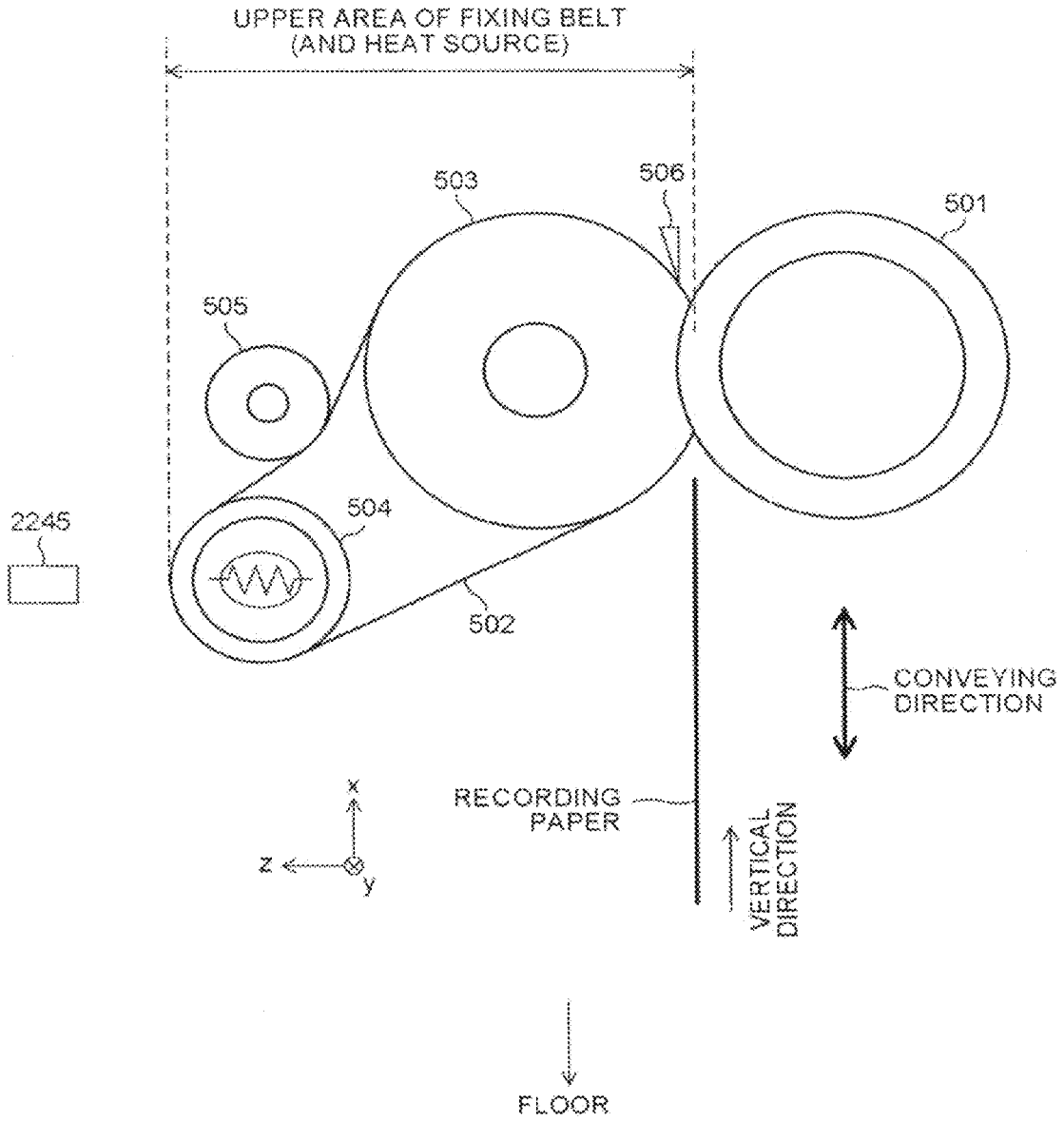
FIG. 30 is a diagram for explaining an upper area of the fixing belt.

FIG. 30 illustrates an upper area of the fixing belt 502. Here, the color printer 2000 is placed on a floor parallel to the yz plane. The +x direction is directed upward in the vertical direction with respect to the floor. Since heat from the fixing belt 502 mainly ascends to the upper area, the reflective optical sensor 2245 can be less likely to be affected by the heat by being placed away from the area. According to experiments conducted by the inventors, it is found that while the temperature in the upper area of the fixing belt. 502 reaches approximately 100° C., the temperature at the position of the reflective optical sensor 2245 illustrated in FIG. 30 can be suppressed to 70° C. or lower. At 70° C., the properties of the optical plastic materials can be maintained.

Figure 31:
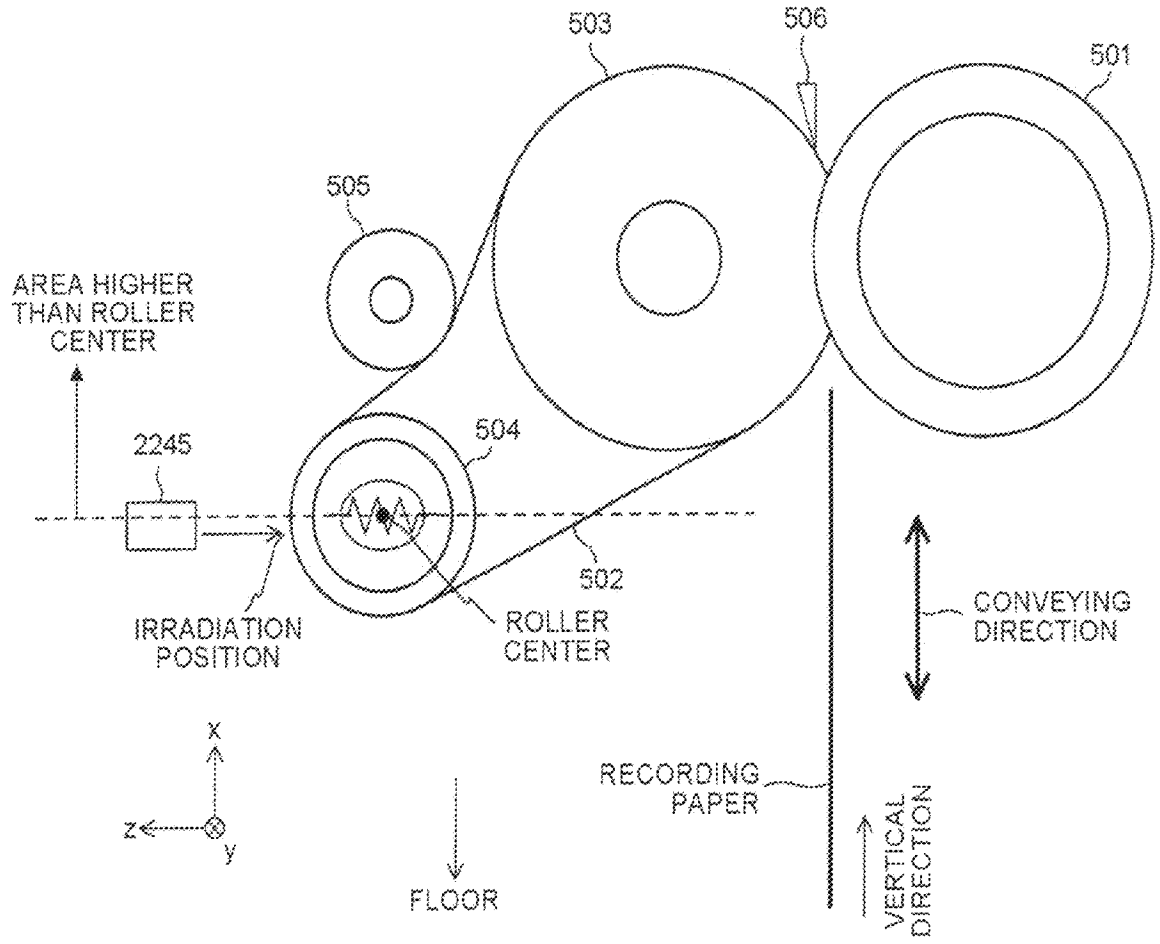
FIG. 31 is a diagram for explaining a center position of a heating roller (roller center)

FIG. 31 illustrates a position irradiated with light from the reflective optical sensor 2245 and a roller center that is a center position of the heating roller 504. In consideration of an increase in the ascending heat from the fixing belt 502 and the heat source (heating roller 504), the reflective optical sensor 2245 can be still less likely to be affected by the heat by being placed at a position lower than the roller center.

Figure 32:
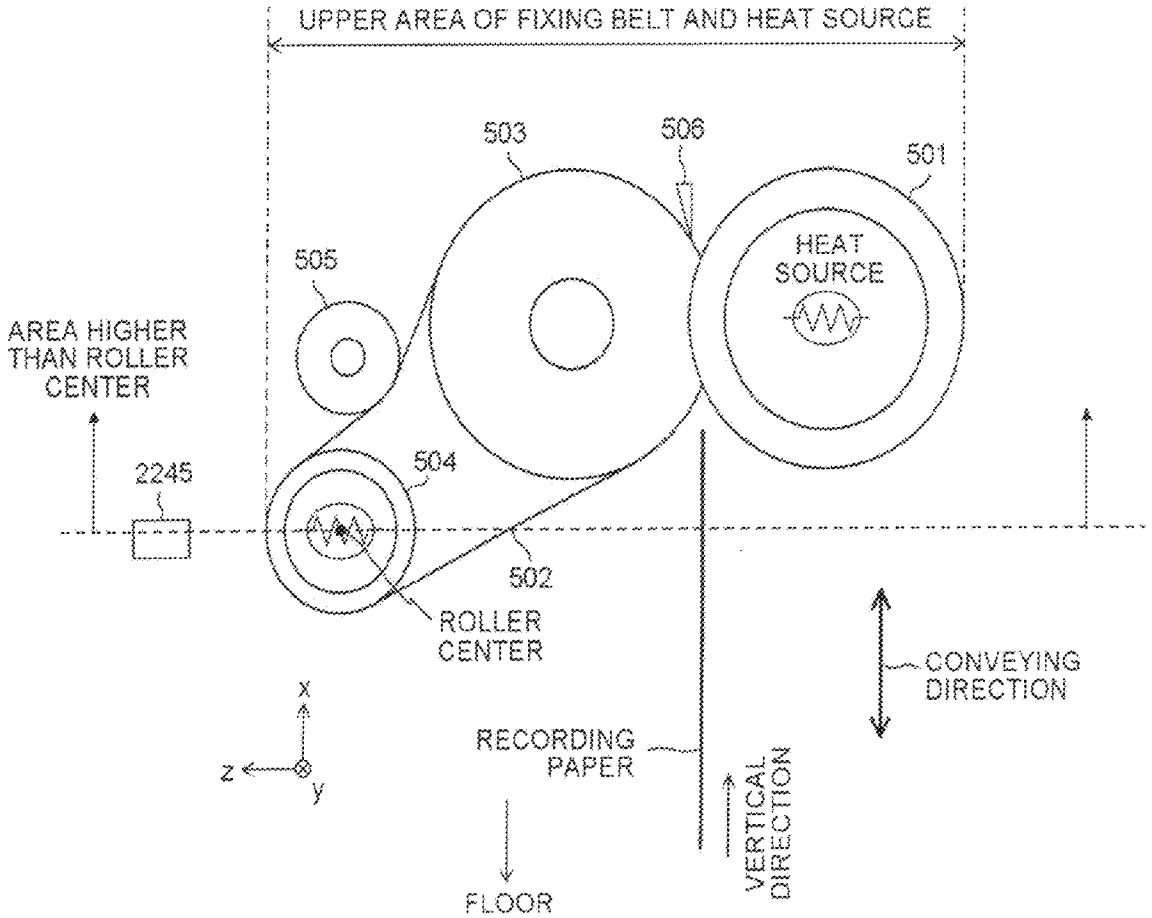
FIG. 32 is a diagram for explaining a case in which a heat source is also provided inside of a pressure roller.

FIG. 32 illustrates a case in which a heat source is also provided inside the pressure roller 501. In this case, the reflective optical sensor 2245 is preferably not placed at a position higher than the center of the heating roller 504 and the center of the pressure roller 501 that are heat sources. Thus, the reflective optical sensor 2245 can be less likely to be affected by heat by being placed at a position lower than all the heat sources.

Figure 33:
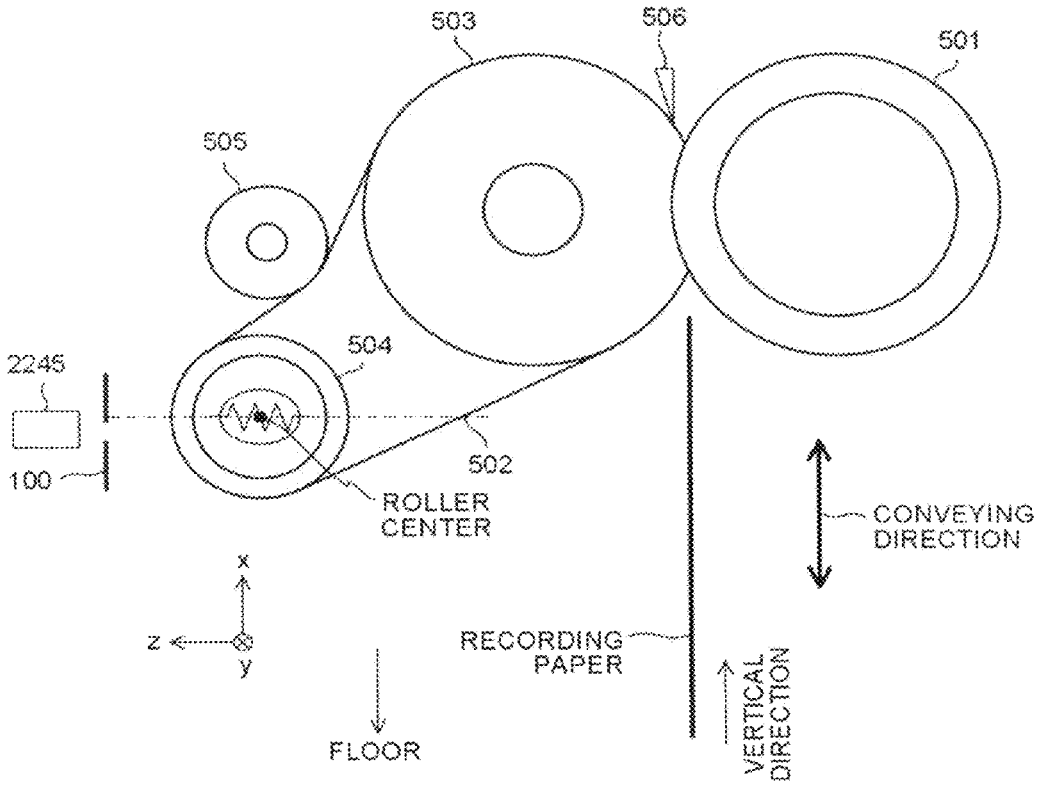
FIG. 33 is a diagram for explaining a case in which a heat shielding member is provided.

FIG. 33 illustrates a case in which a heat shielding member 100 is further provided. In this case, the influence of the heat can further be suppressed.

Specifically, as a result of placing the reflective optical sensor 2245 away from the upper area of the fixing belt 502 that is a heating element, the reflective optical sensor 2245 is less likely to be affected by heat and degradation in the detection accuracy can be prevented. Furthermore, as a result of placing the reflective optical sensor 2245 at a center position of the heating roller 504 or lower, the reflective optical sensor 2245 can be still less likely to be affected by heat.

According to the image forming apparatus of the present invention, good quality images can be formed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a fixing member to fix an image on a recording medium moving in a first axis direction;

at least one reflective optical sensor to emit light toward the fixing member and receive light reflected by the fixing member;

a heat shield between the fixing member and the at least one reflective optical sensor, has a light passing part through which light directed to the fixing member from the at least one reflective optical sensor and light reflected by the fixing member and directed to the at least one reflective optical sensor passes, and prevents heat transfer from the fixing member to the at least one reflective optical sensor;

a processor configured to obtain a surface state of the fixing member on the basis of an output signal from the at least one reflective optical sensor, an adjustment mechanism to adjust a position of the at least one reflective optical sensor in a second axis direction perpendicular to the first axis direction, wherein a position in the second axis direction of the light passing part of the heat shield is adjustable according to the position of the at least one reflective optical sensor.

2. The image forming apparatus according to claim 1, wherein a position of the at least one reflective optical sensor in the second axis direction is manually adjustable.

3. The image forming apparatus according to claim 1, wherein a length of the heat shield in a second axis direction perpendicular to the first axis direction is equal to or longer than that of the fixing member in the second axis direction.

4. The image forming apparatus according to claim 1, wherein the at least one reflective optical sensor includes multiple light emitting units disposed along a second axis direction perpendicular to the first axis direction.

5. The image forming apparatus according to claim 1, wherein the at least one reflective optical sensor includes multiple light emitting units disposed along a direction inclined with respect to a second axis direction perpendicular to the first axis direction.

6. The image forming apparatus according to claim 5, wherein the at least one reflective optical sensor sequentially turns the light emitting units on and off.

7. The image forming apparatus according to claim 1, wherein the number of the at least one reflective optical sensor is one, multiple recording media having different length from one another in a second axis direction perpendicular to the first axis direction are used, and the reflective optical sensor is at a position opposed to a position of the fixing member where one end in the second axial direction of each of the recording media other than a recording medium having the largest length in the second axial direction passes.

8. The image forming apparatus according to claim 1, wherein the fixing member is a fixing belt.

* * * * *